US012522262B2

(12) United States Patent
Siriwongpairat et al.

(10) Patent No.: US 12,522,262 B2
(45) Date of Patent: Jan. 13, 2026

(54) SYSTEMS FOR COMMUNICATIONS BETWEEN HEAD OF-TRAIN AND END-OF-TRAIN

(71) Applicant: Meteorcomm, LLC, Renton, WA (US)

(72) Inventors: Wipawee Siriwongpairat, Renton, WA (US); Thanongsak Himsoon, Renton, WA (US)

(73) Assignee: Meteorcomm, LLC, Renton, WA (US)

( * ) Notice: Subject to any disclaimer, the term of this patent is extended or adjusted under 35 U.S.C. 154(b) by 0 days.

(21) Appl. No.: 18/507,064

(22) Filed: Nov. 12, 2023

(65) Prior Publication Data

US 2024/0157987 A1 May 16, 2024

Related U.S. Application Data

(60) Provisional application No. 63/424,786, filed on Nov. 11, 2022.

(51) Int. Cl.
*B61L 15/00* (2006.01)

(52) U.S. Cl.
CPC ..... *B61L 15/0027* (2013.01); *B61L 15/0072* (2013.01)

(58) Field of Classification Search
CPC ..... B61L 15/0027; B61L 15/0072; B61L 15/0054
USPC ..... 701/19, 20
See application file for complete search history.

(56) References Cited

U.S. PATENT DOCUMENTS

| | | | |
|---|---|---|---|
| 4,582,280 | A | 4/1986 | Nichols |
| 5,039,038 | A | 8/1991 | Nichols |
| 5,377,938 | A | 1/1995 | Bezos |
| 5,681,015 | A | 10/1997 | Kull |
| 5,720,455 | A | 2/1998 | Kull |
| 5,757,291 | A | 5/1998 | Kull |
| 6,072,993 | A | 6/2000 | Trikha |
| 7,467,032 | B2 | 12/2008 | Kane |
| 7,742,850 | B2 | 6/2010 | Kane |
| 8,279,796 | B1 | 10/2012 | Cleveland |
| 9,669,850 | B2 | 6/2017 | Fuchs |
| 10,160,466 | B1 | 12/2018 | Potter |
| 10,710,620 | B2 | 7/2020 | Potter |
| 12,022,375 | B2 | 6/2024 | Edmondson |

(Continued)

FOREIGN PATENT DOCUMENTS

| | | | | |
|---|---|---|---|---|
| CA | 2972412 | A1 * | 2/2018 | ..... B60T 13/665 |
| CA | 3219651 | A1 * | 5/2024 | ..... B61L 15/0027 |

OTHER PUBLICATIONS

Meteorcomm LLC, "ITCR 1.1 System Architecture Specification", Doc Revision: 4.0, Doc No. 00002542-A, 2012, 88 pages.

*Primary Examiner* — Hai H Huynh

(74) *Attorney, Agent, or Firm* — Hubbard Law, PLLC; Marc A. Hubbard

(57) ABSTRACT

Methods and apparatus for selecting from among multiple available path for transporting messages between a train application in a head-of-train area (HOT) and a train application in an end-of-train area (EOT), the multiple paths including at least one direct path and, optionally, one or more indirect paths, each path including at least one wireless segment. A communications manager selects a path using a predetermined method that considers, optionally, how many attempts there have been to transmit an application message and one or more predetermined key performance indicators.

23 Claims, 19 Drawing Sheets

(56) References Cited

U.S. PATENT DOCUMENTS

| | | | | |
|---|---|---|---|---|
| 12,240,507 | B2 * | 3/2025 | Bolte | B61H 13/00 |
| 12,377,891 | B2 * | 8/2025 | Fernandes | B61L 15/0054 |
| 2007/0170314 | A1 | 7/2007 | Kane | |
| 2007/0236079 | A1 | 10/2007 | Kull | |
| 2010/0130124 | A1 | 5/2010 | Teeter | |
| 2017/0088153 | A1 | 3/2017 | Fernandes | |

* cited by examiner

SYSTEMS FOR COMMUNICATIONS BETWEEN HEAD OF-TRAIN AND END-OF-TRAIN

This application claims the benefit of U.S. provisional application No. 63/424,786, filed Nov. 11, 2022, which is incorporated by reference in its entirety for all purposes.

BACKGROUND

The disclosure generally relates to communicating messages between railroad applications running in an end-of-train area and a head-of-train area. Modern railway operations involving long trains often need an "end of train" (EOT) unit or device attached to the rear of the last car of a train. Because the final car in a train may change at any point in a trip, the EOT unit needs to be relatively easily and quickly removed by train personnel and attached to the new final car. An EOT unit is, therefore, typically an integrated device with a structure and enclosure that facilitates its attachment and removal from the train car, protects the equipment, and discourages unauthorized access. Initially, EOT units were relatively simple devices with a signal light for the end of the train. However, EOT units have evolved to handle more functions and are now required by regulation on trains that go over 30 miles per hour and operate on heavy grades. EOT units now include additional equipment or components that monitor or interoperate with one or more subsystems on the train and perform signaling and communication functions.

For example, one of the functions of modern EOT units is to monitor the train's braking system pressure at the last car and report it or a loss of pressure to a head of train (HOT) unit or device located in, for example, the lead locomotive. If there is adequate pressure at the train's last car, the cars in front of it will have adequate pressure. Another function of an EOT is to provide emergency braking control to the rear section of a train. For this purpose, EOT units are configured to receive an emergency braking signal from a HOT device and activate braking in response. EOTs may also, for example, include GPS (Global Positioning System) or other components for detecting geolocation to identify the end-of-train, train movement, and train speed. A HOT unit will usually be capable of communicating over the local area network with other systems located at the head of the train in the train's locomotive. HOT units are typically capable of communicating with computers and other circuits used to control the operation of the train and its various subsystems.

The HOT unit and EOT unit typically each have a radio to send messages to each other wirelessly. Wireless messages between EOT and HOT in North America are currently sent over a radio frequency (RF) link in the 450 MHZ band and are expected to conform to the S-9152 standard in the Manual of Standards and Recommended Practices published by the Association of American Railroads (AAR).

SUMMARY

Disclosed are representative examples of embodiments of apparatus and methods for sending messages between an application in a head-of-train area (HOT) and an application in an end-of-train area (EOT) that support the use of multiple communication paths for sending a message between train applications in the EOT and HOT. The apparatus and methods support multiple paths for transporting application messages between the HOT area or EOT area and the selection of one of the paths by a communications controller in the area originating an application. A communication system for EOT/HOT application messaging that implements any one or more of the apparatus or methods enables the system to be capable of supporting the use of existing or legacy radio systems such as the 5-9152 450 MHz radio infrastructure and other radio systems, thus allowing for transitioning to alternative systems that can support higher bandwidths and more reliability while maintaining interoperability with older equipment. Each of the methods and apparatus can also be used to implement a communication system for EOT/HOT application messaging that improves the reliability of communications between the EOT and HOT by enabling selection from among alternative paths to accommodate changing channel conditions, available RF transports, and/or equipment.

One example of an embodiment of a method for sending application messages between an end-of-train (EOT) area and a head-of-train (HOT) area of a train comprises a communications manager receiving from a railroad application in an originating area—either the EOT area or the HOT area—an application message destined for a railroad application in the other of the EOT and HOT areas—the destination area. The communications manager selects a path from two or more possible paths for transporting the application message between the origination area and the destination area and forwards the application message for wireless transmission according to the selected path. The two or more paths may include any two or more of the following: direct wireless paths between the EOT area and the HOT area on one or more RF transports, one or more indirect wireless paths using one or more RF transports, one or more indirect paths through RF links with base stations and one or more IP transport networks, and one or more other types of IP transport networks, such as mobile cellular communication networks, satellite communication networks, and Wi-Fi network.

DETAILED DESCRIPTION

Figure 1:
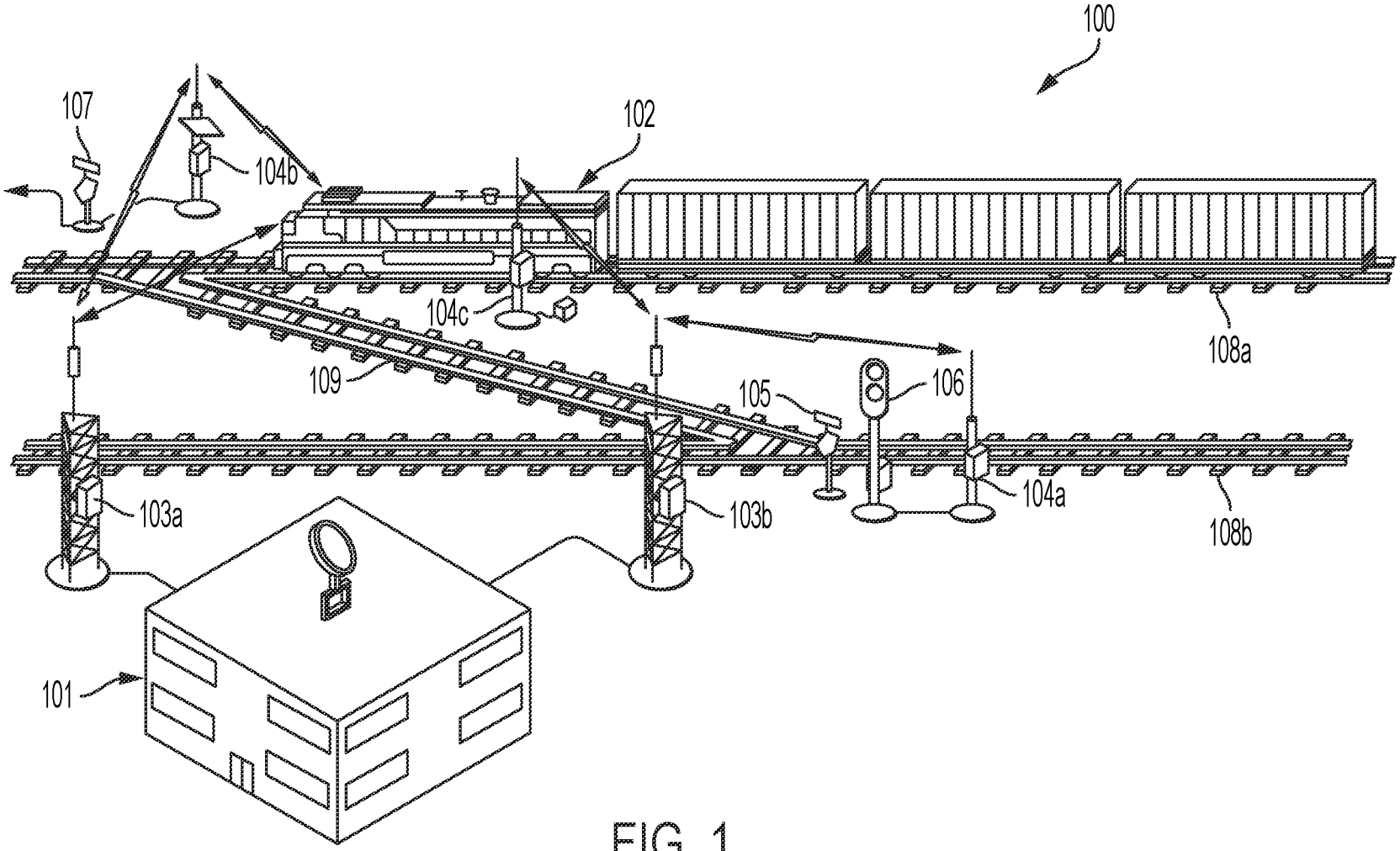
FIG. 1 is a high-level schematic representation of basic functional subsystems or components of a railroad control system.

In the following description, like numbers refer to like elements.

Described below are representative embodiments and examples of communication systems and processes sending messages between an application in an end-of-train (EOT) area, such as an EOT unit, and a head-of-train (HOT) area, which is typically a locomotive. The systems and processes are capable of sending such messages on multiple communication paths. These paths may include a direct wireless path between legacy radios used for EOT/HOT communications, wireless paths using radios that are used for interoperable train control, such as those used for ITCnet, indirect paths through train control networks such as ITCnet, and paths through noninteroperable wireless networks such as cellular and satellite networks. Furthermore, the EOT/HOT messaging systems and processes use an application messaging system for routing application messages within the EOT and HOT areas and over IP transport networks that are used to transport the messages. This application messaging system may, optionally, also support interoperable positive train control. An example of such a messaging system currently in use is the ITCM messaging system described below.

By way of background, railroads in the United States and Canada have implemented centralized traffic control (CTC) systems that enable a dispatcher at a central office or central dispatch office to monitor and control interlockings and traffic flow within a designated territory. A complex collection of interconnected wired and wireless networks is typically relied on by a central office to communicate with wayside devices and trains. The wireless networks are usually spread over large geographic areas. They are comprised of base radios that are installed at fixed locations to provide RF connectivity between back office (BO) applications at central offices or other back office locations and applications running in remote areas (locomotives and waysides). Backhaul networks—wired, wireless, or a combination—are used to connect the base station radios to back offices and, optionally, to each other. The base station radios are used to establish and maintain wireless communication links with locomotives, service vehicles, and wayside devices and systems operating within the coverage area for the base station.

The positive train control (PTC) system is an application implemented by railroads in North America that is intended to prevent train-to-train collisions, over-speed derailments, incursions into established work zone limits, and the movement of a train through a switch left in the wrong position. The PTC system relies on wireless communication links to transmit messages between the functional subsystems used in controlling movement on railroads. The functional subsystems include, for example, wayside units such as crossing signals, switches, and interlocks; mobile units, such as locomotives and other equipment that travel on the railways and their onboard controllers; and dispatch units located in central offices. Each functional subsystem consists of a collection of physical components comprising computers or other types of information processing equipment that are programmed to perform control processes, data storage components for storing databases and other information, and communication interfaces through which messages are exchanged.

Designing and operating a communications system for railroad applications that supports interoperability, particularly one as complex as the system of railroads in the United States, requires addressing many constraints. In the railroad industry, for example, a reliable and efficient communications system must be capable of handling different types of information, including data transmitted from the railroad central office and wayside systems to the locomotive's onboard computers, as well as voice transmissions between train crews and the central office. Wireless communication systems supporting an interoperable positive train control (IPTC) must also meet the requirements and goals of the Rail Safety Improvement Act of 2008 and transmission band requirements mandated by the Federal Communications Commission (FCC), including, for example, those related to frequency band allocation, channel width, and spacing. Moreover, an IPTC system must also meet all the engineering demands placed on any system being deployed in the harsh railroad operating environment.

Making a PTC system "interoperable" requires that locomotives of both a host railroad and a tenant railroad be able to communicate with and respond to the PTC system while supporting uninterrupted movements over property boundaries. The Class I freight railroads in the United States formed PTC-220 LLC to secure the 220 MHz spectrum as a data radio infrastructure to carry PTC data between base stations, wayside, and mobile units. Interoperable transport allows direct communications between the remote asset of one railroad (for example, a locomotive) and the back office of another railroad.

The only nationwide interoperable wireless transport network in the United States for train control applications in the 220 MHz spectrum reserved for train control is called ITCnet®, which was developed by Meteorcomm, LLC of Renton, Washington. ITCnet® is currently capable of, for example, transporting messages for CTC, IPC, IPTC, and other systems used by railways in North America. It also allows for mobile, wayside, and base station radios to communicate with each other over narrowband channels in the 220 MHz band.

The protocols developed for ITCnet, some of which are specified in the Interoperable Train Control Radio (ITCR) standard, support interoperable PTC functions within the available spectrum of 220 MHz. The ITCR standard and U.S. Pat. Nos. 8,340,056, 8,602,574, and 10,710,620, which are incorporated herein by reference for all purposes, disclose and describe various aspects of communication processes relating to the ITCnet® radio network. The ITCR standard specifies a common air interface that focuses on the communications aspects of the PTC system in the 220 MHz band, including operations in the network, link, and physical layers, for the transport of positive train control (PTC) messages between base stations and train locomotives using RF links specified by the ITCR standard.

An application messaging service called Interoperable Train Control Messaging (ITCM) is used by PTC and other railroad applications (not just positive train control applications) to exchange messages between applications over any type of connection or transport, regardless of location. ITCM messages can be transported by interoperable networks, such as networks that support ITC and Wi-Fi networks, using the ITC Interoperable IEEE 802.11 Network Transport protocol. However, ITCM can be supported by network transports that are not interoperable for positive train control purposes. Examples of non-interoperable networks include cellular, satellite, other types of mobile wireless networks, and packet-switched computer networks that use Internet Protocol (IP) for routing ("IP networks") between endpoint hosts.

The ITCM messaging system specification is described in "ITC Messaging System Architecture," SWD-PTC-00001004-A (Jan. 20, 2011). ITCM is also described in U.S. Pat. No. 10,160,466. The referenced ITCM specification and the patent are each incorporated herein by reference for all purposes. An ITCM messaging system can be capable of managing the routing of messages between train-related applications using an application-level protocol such as Edge Messaging Protocol (EMP), ITC System Management Protocol (SMP), and AMQP. These are industry-standard protocols. References to an industry-standard protocol are intended to include all future revisions to the standard and replacements of it unless otherwise stated. The ITCM Messaging system also manages the underlying Class D messaging transports (TCP/IP or UDP/IP connections) that are used to move application messages between ITCM messaging system nodes that are endpoints for message transport endpoints, such as application gateways. Class D messaging is an industry standard described in the Class D Messaging Specification, Standard S-9356, of the Association of American Railroads (AAR.) Each node of the underlying message transport networks has an IP address, and each link is assigned a TCP socket at each node when it is set up. A packet received at a node of the transport network will, therefore, have an IP header and TCP header in addition to a Class D header.

ITCM expects an IP transport for the messages. If non-IP transport is used, a bridge is used to hide the details of the underlying transport. ITCnet 220 MHz air interface is not an IP transport. For ITCnet, a bridge between the local IP network or subnet with the railroad area (HOT, EOT, wayside, and back office) is referred to as an external link manager (ELM) on the back-office side of a base station radio and a connection manager (CM) on the remote area side of the remote radio. An ELM and CM do not run on the radio. Typically, they will run on the same platform (hardware/software) as the application gateway or other messaging system component in the area. In the case of a remote radio, it would be a computer on the same local subnet as the radio.

The ELM or CM communicates with the wired interface of the 220 MHz radio using an interface protocol called Host/Radio eXchange (HRX) protocol. The ELM and CM transform the ITC messaging protocol into a radio wire protocol. They may also route messages received from the messaging system based on which base station a remote radio is connected to. Each receives updates from the radio with active connections that the radio has. A CM may choose between different available transports, such as 220 MHz radio, cell, satellite, and Wi-Fi for outgoing messages. A connection manager receives connection updates from the 220 MHz radio and keeps track of currently active connections to a base station. At a base station, an ELM communicates with an application gateway to set up a link for exchanging application messages. However, an ELM and CM are not required for ITCM messaging system traffic. Messages may bypass the ELM or a CM, if desired, by using the Host/Radio eXchange (HRX) protocol to interface directly with the 220 MHz radios. ELMs and CMs may also support messaging systems or application messaging systems other than ITCM.

The application gateway is another component of the messaging system that acts as a bridge between an application-level protocol, for example, the industry standard Edge Messaging Protocol (EMP), and the transport protocols (UDP, TCP, Class D, JMS) that are used to move a message between application endpoints. Class D layer protocols make a link between an application and an application gateway reliable by providing reliable point-to-point message delivery using an underlying TCP/IP transport. The Class D protocols define, for example, expected behaviors concerning the establishment of connections, keep-alive messages, and error handling. It also defines configurable features such as message acknowledgment and transport layer security (TLS). From the perspective of the ITCM messaging system, the Class D protocol implements the behaviors of the data link layer in the OSI model. Details of the EMP protocol are published in "Edge Message Protocol Specification," Standard S-9354 (2010) of the American Association of Railroads (AAR). The Class D protocol is described in the AAR S-9356 Class D Messaging Specification. Both are incorporated herein by reference for all purposes.

FIG. 1 is a high-level schematic representation of basic functional subsystems or components of an interoperable railroad control system. In this representative example, an interoperable railroad control communication system 100 supports wireless communications between a central or back office (or network operating center) 101 and locomotives 102 and other railroad vehicles located at various points around a rail system, as well as direct communications between locomotives 102 and electronic wayside monitoring subsystems. In communications system 100, central office 101 communicates with packet data radios on locomotives 102 through telecommunications networks and packet radio base stations dispersed over thousands of square miles through which the rail system operates. FIG. 1 illustrates only two representative radio base stations, 103*a* and 103*b*.

The communications system 100 also includes a series of wayside monitoring subsystems, which monitor wayside systems, such as signals, switches, and track circuits, and communicate the monitored information directly to locomotives 102 within the corresponding wireless coverage area, as well as to the central office 101, through base stations 103*a* and 103*b*. FIG. 1 includes several representative wayside monitoring subsystems 104*a*, 104*b*, and 104*c*. As examples of typical uses of wayside monitoring subsystems, wayside monitoring subsystem 104*a* monitors a switch 105 and a signal 106, and wayside monitoring subsystem 104*b* is shown monitoring a hand-throw switch 107. Also, for illustrative purposes, two parallel sections of tracks 108*a* and 108*b*, and a connecting section 109, are shown in FIG. 1, which represent only a small part of the overall track system.

A "remote radio" refers to a radio that is not at a base station. Remote radios are, for example, the radios disposed on locomotives 102 and other railroad vehicles, the radios at waysides 104*a*, 104*b*, and 104*c*, and other radios geographically separated from central office 101, and which are not radios at base stations 103*a* and 103*b*. Mobile remote radios refer to the remote radios disposed on locomotives 102 and other railroad vehicles or any other remote radio that might change location.

Remote radio and base station radios can be implemented using a software-defined radio (SDR). An SDR provides several possible advantages, including multi-channel capability. Thus, for example, a remote radio with multi-channel capability on the locomotive enables it to receive information from a base station and a wayside monitoring subsystem 104 simultaneously. Additionally, with an SDR, locomotives and base stations can receive status messages from multiple wayside monitoring subsystems simultaneously. This capability enables support for communications with a high density of waysides in city areas.

One challenge with interoperative train control applications, such as IPTC applications, is the need to maintain multiple communication paths between various communications nodes within the system. In addition, these multiple communications paths must support the exchange of different types of information while still meeting applicable regulatory requirements on the use of the radio spectrum. For example, a communication path must be maintained between mobile remote radios on locomotives and a central office to support the exchange of such information as locomotive location reports, locomotive health and diagnostic data, movement authorities, files, and network management data. Another communication path must be established between the mobile remote radios on railroad non-locomotive vehicles (not shown) and the central office. The data traffic in this path includes vehicle location reports, work reports, emails, and material requisitions.

Another set of communication paths is required for maintaining communications with the fixed remote radios at railroad waysides. In this case, a communication path is required between the radios at waysides and a central office for supporting signal system health and status monitoring, centralized control of control points, and wayside defect detector system data and alarms. A further communication path is required between the mobile radios on locomotives and the radios at waysides, which supports wayside status updates provided to locomotives in the proximity of a given set of waysides. In a PTC system, trains generally require a status update from each approaching wayside. For each wayside within 3.5 miles ahead of a train, the age of the wayside status must not exceed 12 seconds with six 9s (i.e., 99.9999%) reliability. It is also desirable that the wayside status updates be forwarded to a central office.

Finally, another communications path is required between the mobile remote radios on locomotives and non-locomotive railroad vehicles and the mobile remote radios on other locomotives and non-locomotive railroad vehicles. This path supports peer-to-peer proximity position reports so that one mobile radio is aware of the locations of nearby mobile radios. In the 220 MHz frequency band (the MHz frequency band spans 220 MHz to 222 MHz) designated for use by IPTC in the United States, channels that are in a group of RF frequencies in the 220 MHz band according to a channel plan specified by the FCC (Federal Communications Commission) in 47 CFR § 90.715.

Mobile radios may transmit on channels in the 221-222 MHz range or on channels in the 220-221 MHz range. Base stations are currently only permitted to transmit on channels in the 220-221 MHz range. For IPTC applications, the frequency channels in the 220 MHz band are divided into the frequency channels used by base station radios and the frequency channels used by mobile radios. Each base station radio transmit frequency is taken from the 220-221 MHz range and paired with a mobile radio frequency from the 221-222 MHz range. According to current FCC regulations, a mobile radio may transmit or receive on either a mobile radio or base station radio frequency, while a base station radio may transmit only on a base station radio frequency. The FCC channel plan describes 5 kHz channels. However, where a licensee is authorized on adjacent channels, the 5 kHz channels can be aggregated over the contiguous spectrum. The bandwidth of a channel is currently specified to be 25 kHz. It is comprised of five (5) adjacent 5 kHz channels in the FCC channel plan. This makes at least four 25 kHz channel pairs in the 220 MHz band currently available for IPTC. IPTC systems use each 25 kHz frequency channel in a half-duplex mode, meaning that a single channel is used as a communication path in both directions between two connected radios, but only in one direction at a time. In other words, each frequency channel supports both transmissions from a base station radio and transmissions from remote radios, but not simultaneously. If more than one radio transmits in the channel at the same time, then a signal collision occurs that could result in the loss of all transmissions. However, the limitations on use and the channel plan can change without affecting the use of the subject matter disclosed herein.

In the current channel plan, available 25 kHz frequency channels are divided into two groups: local channels and common channels. A common channel is shared by all base station radios and remote radios. A local channel is used to support the traffic from all users within a base station coverage area and is centrally controlled by that base station using a master-slave architecture. Each base station typically controls only one local channel but could control more than one. Each local frequency channel is controlled and organized by a base station.

Each remote radio can listen to multiple base stations 103, but a remote radio can select only one base station 103 to be its master; other base stations 103 are considered as neighbor base stations of the remote radio. Different local channels can be assigned to adjacent base stations 103 to prevent adjacent base stations 103 from interfering with each other, and the same local channel can be reused by multiple base stations 103 that are far apart from each other to increase spectral efficiency.

A set of 25 kHz channels in the base station frequency are set as primary local channels. Since base station 103 can transmit with a higher power in the base station radio frequency, using channels in the base station radio frequency for local channels provides broader coverage than using channels in a mobile radio frequency. Based on the currently available 220 MHz IPTC spectrum, at least three 25 kHz channels in a base station radio frequency can be set as primary local channels. In high-density areas where three primary local channels are not sufficient to support the traffic, other local channels can be used.

In ITCnet®, one 25 kHz channel is preferably reserved for a common channel. The common channel should be in a base station radio frequency that allows for both base stations 103 and remote radios to transmit in the channel. The common channels are shared by every user using the CSMA scheme described above. A packet transmitted in the common CSMA channel is typically a short packet that carries very high-priority data. The common channel can also be used to transmit base station beacon signals, which carry information necessary for remote radios to identify and select a base station radio, as well as to set up their receive frequencies.

Figure 2:
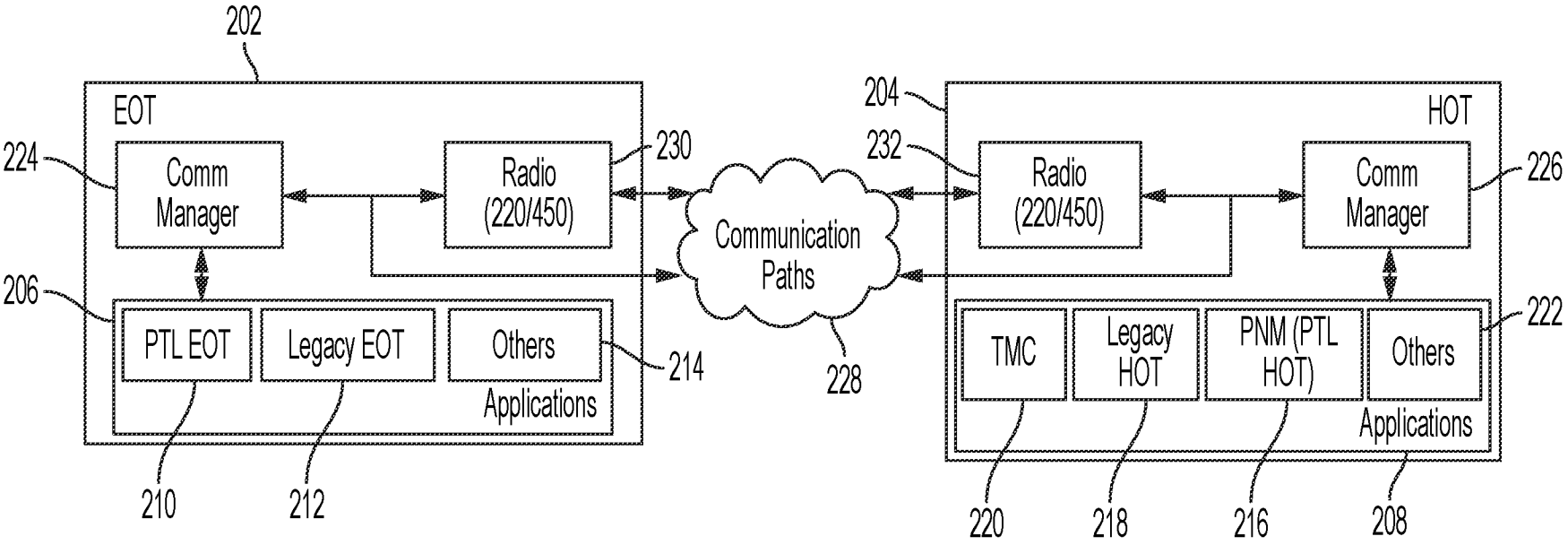
FIG. 2 is a block diagram illustrating a representative embodiment and example of components in the EOT and HOT areas for a HOT-EOT communication system.
Figure 3:
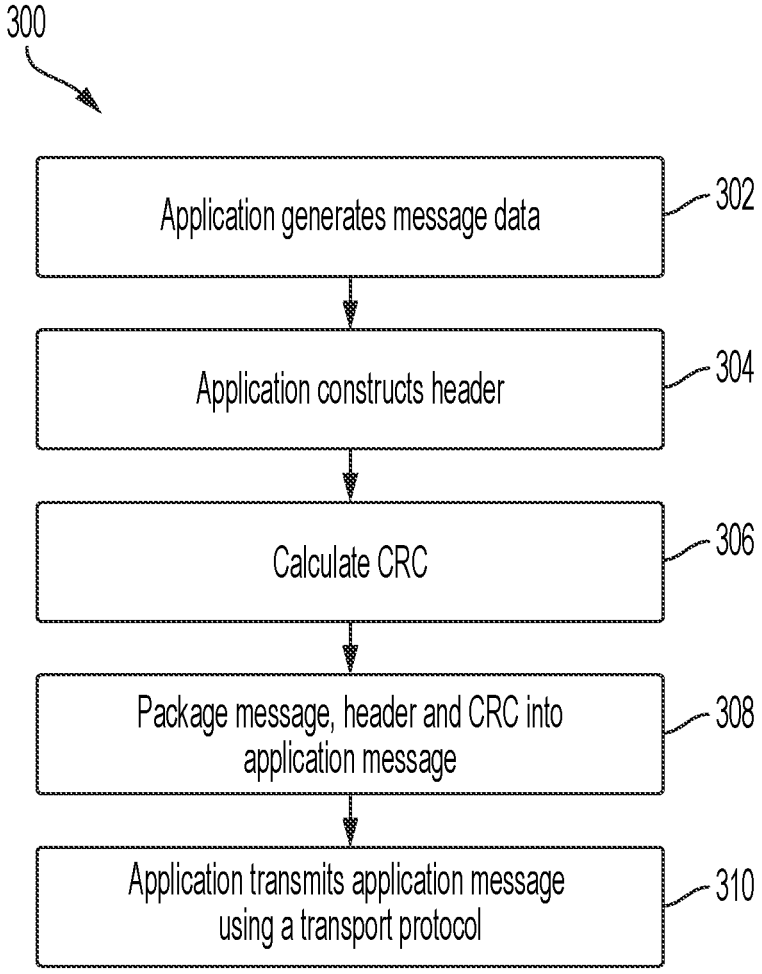
FIG. 3 is a flow diagram for a process of the communication system of FIG. 2.

Turning now to representative embodiments and examples of an improved HOT/EOT communication system, FIGS. 2 and 3 schematically illustrate a representative embodiment that is configured to be capable of selecting from among multiple—two or more—available communications paths to accommodate the availability of different network transports and different conditions that might affect the reliability of delivery of the application message. A communication path can be defined by the wireless transport used, which may determine whether the path is direct or indirect and, if indirect, the other network(s) over which the application message is transported. A wireless transport can be, for example, by type, the frequency bands being used, and the transmission protocols being used. Depending on the wireless transport, the path may be further defined, from the perspective of the EOT and HOT areas, by parameters such as channel, packet type, addressing, and other parameters that can be selected or changed by the EOT area or HOT area for initial transmission of the application messages. These choices can determine the subsequent path taken by the message.

The system contemplates at least one end-of-train (EOT) area 202 and at least one head-of-train (HOT) area 204. The EOT area is located at or near the end of a train, typically in the form of a special, self-contained unit that can be attached to and detached from the last car because the last car can change. The HOT area is usually located in a lead locomotive of the train. The system enables one or more railroad applications 206 on a host computer located at the end of the train to communicate with one or more railroad applications 208 at the head of the train. "Application" refers to a system or a component that is part of the system used in the operation of a railroad, including train control and other services and functions that otherwise support the operation of a railroad. In the case of an EOT or HOT application, it is a component of the railroad application located in an asset such as a locomotive or an EOT unit that communicates with other components of the application that may be located elsewhere, such as in a back-office control center or network operations center, a wayside, or another mobile unit.

An application hosted by an asset (locomotive, wayside, or EOT unit, for example) will typically be implemented by software programs stored in memory and executed by, for example, a microprocessor, digital signal processor, or microcontroller. It could also be implemented using firmware and one or more programmable logic devices, gate arrays, field-programmable gate arrays, application-specific circuits (ASIC), or a combination of several types of hardware circuits, firmware, and software. The EOT or HOT application will generally communicate with separate components (for example, a radio or software application on a different host) over a local area computer network, which could be as simple as, for example, an Ethernet cable connecting network interface cards in each of the two components but may also include network switches and routers.

Representative examples of EOT applications 206 that could be located at the end of the train include train location (PTL) 210, legacy EOT communications 212, point protection, and other applications 214. Representative and non-limiting examples of HOT train control applications 208 include positive navigation module (PNM) 216, which is used for the PTL in the HOT area, point protection, legacy HOT applications 218, train management computer (TMC) applications 220, and others 222.

The example of an embodiment EOT-HOT communications system shown in FIG. 2 supports the use of multiple different transport paths for messaging between the EOT and HOT applications, including the selection of a path from among multiple paths that might be available to transport a message.

The EOT has a communications manager 224 that interfaces with the EOT applications 206. The HOT also has communications manager 226 that interfaces with HOT applications 208. When an application message is received from an EOT or HOT application, the communications manager selects one of the available communication paths, which are collectively represented by cloud 228, to transport the message and routes the message according to the selected path. This embodiment of the EOT-HOT communications system supports the possibility of two or more communication paths, though only one might be available, as the number of paths that are available depends on the capabilities of the EOT and HOT. In the illustrated example, possible paths include wireless transport in the 220 MHz and/or 450 MHz frequency bands between one or more EOT radios 230 and one or more HOT radios 232. However, it may also be sent over other wireless and wired IP network transports, which are represented by the lines going directly from each of the communications managers 224 and 226 to cloud 228. A communications manager can be implemented, for example, as a programmed process executing on a special or general-purpose microprocessor. It could be, for example, but does not have to be incorporated into a unit containing one or more radios, the unit having a network interface for enabling it to communicate over a local area network with the systems that implement the EOT and HOT applications and other transport networks.

In the standard OSI network model, a messaging service operates at layer 4 and is responsible for transporting messages across one or more transport networks. A message may be broken into fragments for transport by packets. Processes at the OSI network layer 3 handle source-to-destination packet delivery over the transport network, including routing through intermediate hosts, node connectivity, routing, congestion control, flow control, segmentation, and packet sequencing between nodes. The messages or message fragments from an application are encapsulated in layer 4 headers before being packetized for routing with layer 3 headers, for example, TCP/IP headers, for delivery to the address specified in the layer 3 header.

A basic message flow is illustrated by flowchart 300 in FIG. 3. At step 302, a message is generated at an application, such as one of the EOT applications 206 or HOT applications 208. After message data is generated by an application, an application-level protocol header for routing the application data between messaging system endpoints is constructed by the application at step 304. In the ITCM messaging system, the header is constructed according to a railroad industry standard Edge Messaging Protocol (EMP). The application data and EMP envelope comprise the application message that will be transported by the messaging system.

EMP messages must be transported over a Class C or Class D link, depending on whether the underlying transport is a UDP/IP or TCP/IP connection. A Class D link enables the communication manager to share acknowledgments and errors with the application. Therefore, because this example uses EMP, a Class D header is added for transport over a TCP/IP connection with the communications manager. After the construction of the header at step 304, a CRC (Cyclic Redundancy Check) is calculated at step 306. The EMP envelope with the message data inside, Class D header, and CRC are packaged at step 308. The package is then forwarded over the TCP/IP connection at step 310 to a communications manager.

The EMP header includes information, including message type and a source and destination EMP address for the message. An EMP address is made up of a network name and a messaging name. The network name identifies the railroad system asset where the messaging system endpoint is located. The network name includes an identifier for the type of asset and the owner of the asset. The types of assets include a locomotive, wayside, virtual remote, and a back office, for example. The network name is used for building routes over the transport networks to the local network of the asset. The messaging name assists with handling the message within the infrastructure of the asset.

An example of a type of message that could be sent between an EOT area 202 and HOT area 204 is a PTL (Positive Train Location) message. PTL messages are unicast messages that can be sent both periodically and when a track point of interest (TPOI) is detected. The PTL messages originate and are sent from an application in the EOT area and to the HOT area (the destination) and may include legacy fields, EOT positioning, TPOI detection, TPOI reporting, TPOI notification, and sensor status. For periodic transmissions, the PTL message rate can be configured based on the train movement. For example, the current default setting is that the periodic PTL messages are sent every 16 seconds when the train is moving forward and every 16 seconds when the train is moving in reverse. The message traffic can also include legacy EOT application messages and messages related to point protection.

Figure 4:
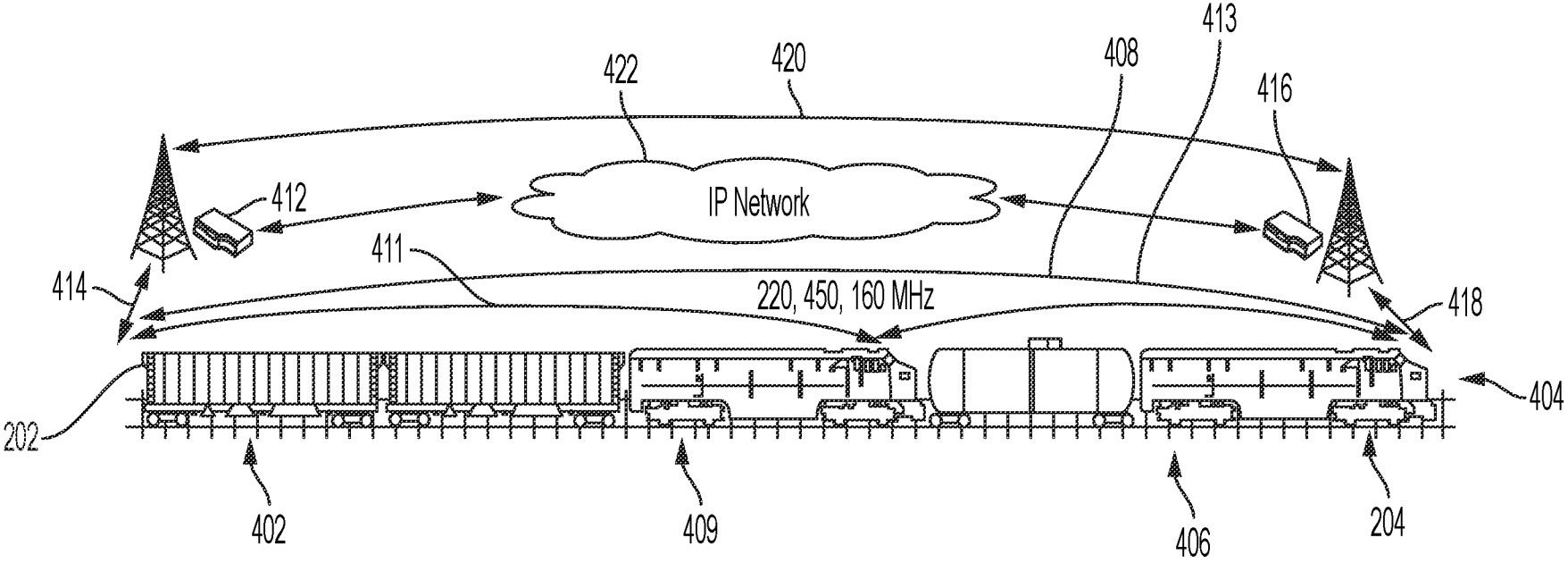
FIG. 4 is a representation of different communication paths supported by an EOT-HOT communication system.

FIG. 4 illustrates examples of possible types of communication paths that an EOT or HOT area can be configured to use for sending an EOT/HOT application message from an application in the EOT area 202 at the end of car 402 of train 404 and the HOT area 204 in the lead locomotive 406, or from the HOT area to the EOT area.

One type of communication path is a direct wireless communication path between the EOT and HOT. Wireless link 408 represents one or more direct wireless paths between the EOT area 202 and HOT area 204 using any one or more different RF transports. Examples of RF or wireless transports include RF transmissions using the "legacy" S-9152 protocol in the 450 MHz frequency band, RF transmissions of wireless packets according to the ITCR protocol in the 220 MHz frequency band, RF transmissions in the 160 MHz frequency band, RF transmissions sent using one or more non-legacy protocols in the 450 MHz frequency band, and RF data transmissions using cellular, Wi-Fi, satellite networks, and other IP transport networks. For ITCR wireless packets in the 220 MHz frequency band, multiple direct wireless paths are possible based on the channel in which the wireless packet is sent, the type of packet sent, and/or other parameters.

A second possible type of communication path is through one or more repeater radios. A repeater is a radio that will receive a wireless packet and retransmit the wireless packet. A repeater could be located on another locomotive at a midpoint in the train, at a wayside, or at a base station. In this example, the messages would be sent using the ITCnet radio protocols in the 220 MHz frequency band. In the depicted example, locomotive 409, located mid-train between the HOT and EOT areas, has a 220 MHz ITCnet radio configured to operate as a repeater. Lines 411 and 413 represent a wireless path between the EOT and HOT to the locomotive repeater.

A third possible communication path is through one or more base station radios. In the illustrated example, a radio in EOT area 202 has an RF link 414 with a first base station radio 412. Similarly, a radio in the HOT area 204 has a radio link 418 with a second base station radio 416. One possible path involves a radio in, for example, the EOT area transmitting a wireless packet with an EOT/HOT application message over RF link 414 to the first base station radio, which then transmits it in a wireless packet transmitted to the second base station radio 416 (or possibly through one or more intermediate base station radios) over one or more radio frequency links as represented by line 420. The second base station then transmits the EOT/HOT application message in a wireless packet to the radio HOT area 204. The base stations may, in this scenario, be acting as repeater radios, simply rebroadcasting the wireless packet on a common channel. However, the first base station may, alternatively, route the EOT/HOT message to the radio in HOT area 204 if it knows a path to it. Thus, in this example, it would know a path that is through the second base. It transmits a wireless packet with the application message to the second base station for delivery to the HOT area.

A fourth possible type of communication path is through one or more message transport networks that connect with one or more base station radios in communication with an EOT area and a HOT area of a train. In the illustrated example, an EOT/HOT application message received by the first base station 412 from the EOT area 202 over a wireless link 414 is transported over one or more IP networks, which are represented by cloud 422, to a base station 416 that can transmit a wireless packet with the application message over a wireless link Examples of such IP networks include backhauls that connect base stations to one or more back offices and IP networks that interconnect back offices. Although not required, the backhaul and IP network can support messaging and transport protocols that provide for reliable transport and delivery of application messages for train applications, such as those described below.

Figure 5:
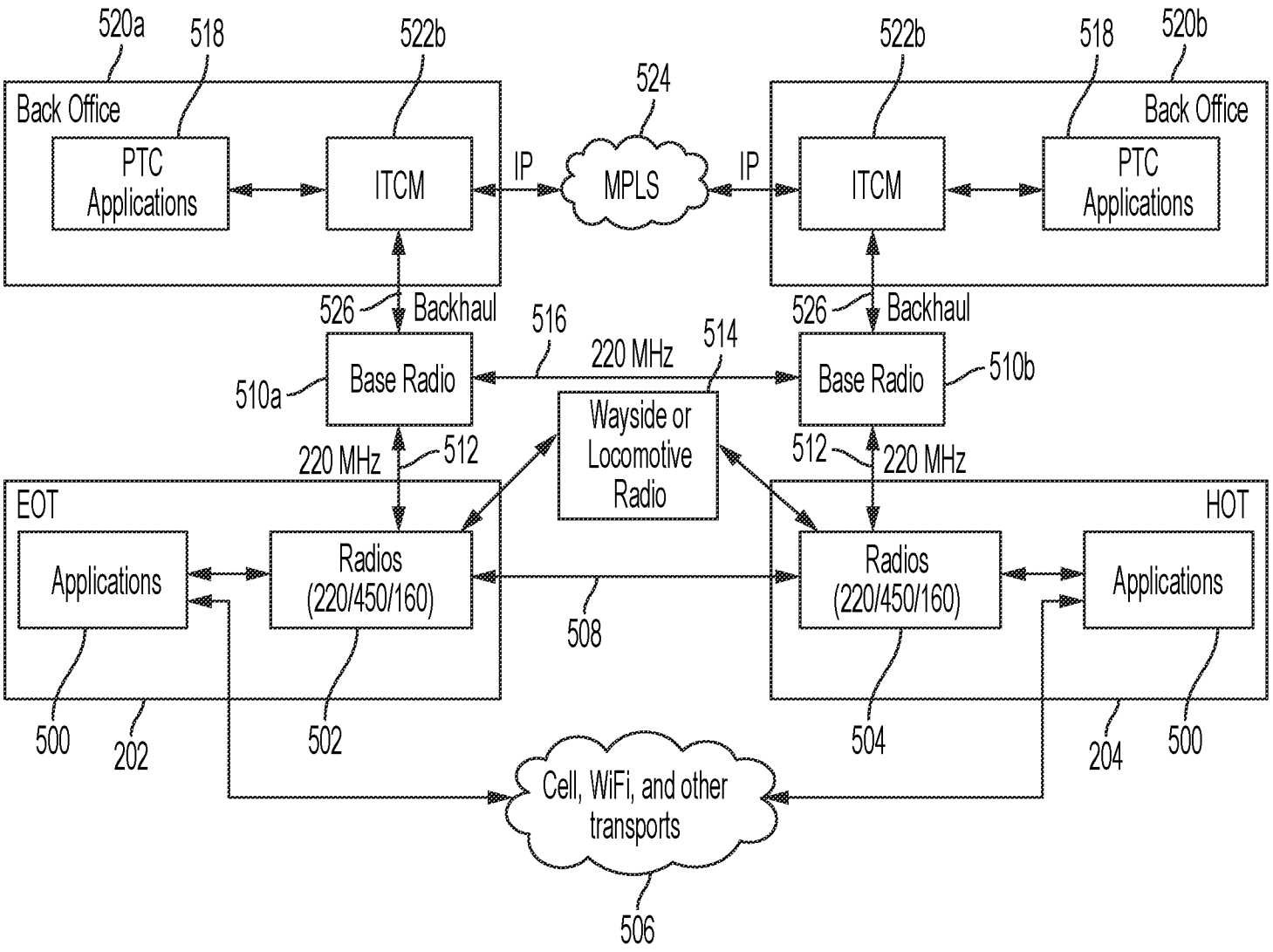
FIG. 5 is a block diagram of components of an embodiment of an EOT-HOT communications system.

FIG. 5 illustrates schematically an example of an embodiment of an EOT and HOT communications system configured for supporting delivery of application messages between EOT/HOT applications 500 over multiple different communication paths, such as those described above in connection with FIG. 4.

Within the EOT area 202 are one or more radios 502. Within the HOT area 204 there are one or more radios 504. The one or more radios represent radios of the type used for train control applications and related railroad applications. For purposes of illustrating the capabilities of an EOT/HOT communication system, the one or more EOT radios 502 and the one or more HOT radios 504 are assumed to be capable of transmitting and receiving wireless packets that carry part or all of an application message in the 450 MHz band using legacy AAR S-9152 RF links, in the 220 MHz frequency band according to ITCR specifications and protocols, in the 450 MHz frequency band using, for example, higher data rate modulation and coding schemes than specified by AAR S-9152; the 160 MHz frequency band; and other frequency bands. The EOT/HOT communications system disclosed herein may also select Wi-Fi, and/or other IP transport networks 506 may also be used as paths for EOT/HOT application messages.

However, the EOT/HOT communication system is not required to support all these paths and may support additional or alternative paths in other frequency bands. Furthermore, not all these paths are required to be available for a particular EOT and HOT on a train. Any given HOT and EOT area is not required to have radios that support all these possible RF connections. The EOT/HOT communication system may be used if, for example, an EOT unit has a single radio capable of operating only in one frequency band. Furthermore, the illustrated example does not imply that the EOT/HOT communication systems disclosed herein exclude the possibility of using another system in addition to the EOT/HOT system to transport messages from EOT and HOT applications.

It is assumed for purposes of illustration that at least one of the at least one or more EOT radios 502 and at least one of the one or more HOT radios 504 is capable of transmitting application messages over a direct wireless path to base station radios of a train control radio network. In one representative embodiment, at least one of the one or more radios 502 in the EOT and one of the one or more radios 504 in the HOT area are at least capable of establishing a direct link 508 with each other using one or more of the following: 220 MHz ITCnet, 450 MHz AAR S-9152, 450 MHz with different data rates or protocols than current AAR S-9152, and 160 MHz frequency band. Representative examples of the base stations, which will be used in the following explanation, are ITCnet 220 MHz base stations. A direct wireless path between EOT and HOT is represented by an RF link 512 that extends from EOT radios 502 to base station 510*a* and direct RF link 512 that extends from HOT radio 504 to base station radio 510*b*.

Wireless packets containing applications may also be sent through an indirect wireless path through a repeater 514 using the same radios as used for the interoperable train control network. The repeater radio could be located wayside, meaning at a fixed point next to the track or at a point on the train intermediate of the EOT and HOT, such as the locomotive 409 in FIG. 4. If the radios being used do not operate on the 220 MHz ITC network, the repeater would need to be a radio capable of receiving and retransmitting wireless packets sent by those radios. If a wireless packet carrying an EOT/HOT application message is received by one of the base station radios 510*a* or 510*b*, it may take any one of several paths. For the purposes of the following description, base station radio 510*a* will be assumed to be the base station that receives the application message from radio 502 in EOT area 202. However, the description is equally applicable to base station 510*b* receiving an application message from radio 504 in HOT area 204. The processes and paths are the same.

The base station 510*a* may, for example, route a wireless packet with an application message that it receives within the radio access network without delivering it to a messaging system endpoint, such as the ITCM application component 522*a* in the back office 520*a*. The ITCM application component could be, for example, an application gateway for PTC applications 518.

By way of background, each base station radio and remote radio—a remote radio is a radio that is not a base station radio—has a unique identifier, which will be referred to as a radio ID. The radio ID is a layer 3 network address. For example, a wireless packet will include a layer 1 header, for example, a preamble used for packet detection and synchronization, and a link layer (layer 2) header with link layer overhead. Link layer overhead may include information needed for demodulating and decoding the payload of the packet, the length of the packet, and information about the type of packet. Depending on the type of wireless packet being transmitted, the wireless packet may include in the payload of the packet the layer 3 network overhead. The layer 3 network overhead may include, among other information, the radio ID of the transmitting radio, the radio ID of the radio to which the wireless packet is being sent (the receiving radio), or both. For a wireless data packet containing user data, layer 3 overhead and the user will be in the payload, the user data including part or all the application message and possibly headers for other layers such as layer 4.

For example, if the radio ID of the destination radio, which is one of the HOT radios 504, is in a routing table maintained by the base station radio 510*a*, the base station may, optionally, transmit the wireless packet according to the routing entry for the destination radio. This might occur when both the originating and destination radios are connected to the same base station—in other words, when the 220 MHz radio that is part of the EOT radios 502 and the 220 MHz radio that is part of the HOT radios 504 are both connected to base station 510*a*. However, it may also occur if the destination radio is connected to a different base station and the base stations share routing information. If the destination is connected to an adjacent base station, such as base station 510*b* as shown in the figure, the receiving base station 510*a* could transmit the received wireless packet to base station 510*b* using the direct 220 MHz wireless path 516. If the base station 510*b* is not adjacent, but there is a route to the destination radio (the 220 MHz radio that is part of HOT radios 504) through an intermediate base station, it could forward the packet to an intermediate base station that is able to forward it to base station 510*b*. This would require routing information to be shared beyond adjacent base stations.

Alternatively, the application message is transported from the receiving base station 510*a* using the ITCM messaging system transports, which include backhaul 526, to an ITCM messaging system component 522*a* that determines from the destination address in the EMP header a route for the message. The route could be to base station 510*b* if that base station is managed by the same back office. However, if it is managed by a different back office, such as back office 520*b*, the route is to the ITCM component 522*b* through a highly reliable connection between the back offices, a label switched path through a Multiprotocol Label Switching (MPLS) network 524. The ITCM components 522*b* at the back office route the message to the base station radio 510*b* over messaging transports, including backhaul 526*b*. The base station radio 510*b* then transmits it to the 220 MHz radio at HOT 204 over an RF link established with the radio.

For purposes of illustration, the one or more EOT radios 502 and the one or more HOT radios 504 are assumed to be capable of transmitting or receiving wireless packets carrying part or all of an application message that is transmitted by the following types of RF links: the 450 MHz band using the legacy AAR S-9152 transmission protocols; the 220 MHz frequency band according to ITCR specifications and protocols; and in the 450 MHz frequency band that uses a higher data rate modulation and coding scheme different than the one specified by AAR S-9152; and over other frequency bands and/or using different air interface and access protocols.

However, a particular implementation of an EOT/HOT messaging system according to any of the representative embodiments of the methods and apparatus described herein, or variants of them, need not support all such wireless transports for application messages. Furthermore, an EOT or HOT area of a given train need not have radios capable of transmitting and receiving using all the wireless transports that a given implementation of an EOT/HOT communication system supports. For example, a particular EOT unit being used on a train might have only a legacy 450 MHz radio. The representative examples of EOT/HOT communication systems disclosed herein can accommodate legacy EOT units while also supporting additional or more advanced wireless transports for application messages.

One example of an implementation of an EOT/HOT communication system supports the use of radios using legacy 450 MHz AAR S-9152 transmissions as a direct path between the EOT and HOT areas, as well as ITCnet 220 MHz transmissions on one or more direct paths between EOT and HOT areas and/or one or more indirect paths, such as those involving repeater radios and ITCnet base stations as described herein. This example may, optionally, further support one or more of the following: radios capable of transmitting at higher data rates in the 450 MHz frequency band between the EOT and HOT, Wi-Fi, and radios for other wireless access networks capable of supporting interoperable train control applications, as well as network interfaces or modems to other types of IP networks that do not support interoperable train control, such as Wi-Fi, cellular and satellite networks. An EOT/HOT messaging system capable of supporting multiple wireless or RF transports allows for transitioning of equipment from legacy S-9152 EOT/HOT communications while providing flexibility for alternative transports, both interoperative and non-interoperative, that might be used to support communications with the EOT and between the EOT and HOT.

The apparatus and methods described herein are not limited to a particular type of implementation of the one or more EOT radios and the one or more HOT radios. One or more of the EOT and HOT radios can be implemented but does not have to be implemented using an SDR (software-defined digital radio), as mentioned above. SDRs are well known and can provide several possible advantages, including the ability to operate concurrently in different frequency bands and in multiple channels, to use different air interface protocols and access schemes, and the ability to adapt to different channel conditions. Thus, instead of having a separate radio for each wireless transport, a single radio could be used for supporting transmission on any two or more wireless or RF transports.

An SDR implements some conventional components of a radio, such as modulators, demodulators, filters, and mixers, using software running on a processor or other programmable hardware, examples of which include digital signal processors (DSP), field-programmable gate arrays (FPGA), and general-purpose processors. In addition to hardware for executing the processes, an SDR will also have additional hardware, such as memory for storage, analog amplifiers and filters for its RF stage, analog to digital (ADC) and digital to analog (DAC) converters, interfaces, and power supplies. A digital radio receiver functions or acts like a conventional radio but processes a digitized version of an RF or IF frequency division multiplexed (FDM) signal for an entire band. After the received RF or IF frequency signal is processed by a radio frequency (RF) stage, the digital receiver samples the FDM signal using an analog-to-digital converter to generate a discrete, time-invariant signal representing a continuous sequence of samples. The digitized FDM signal is then demodulated and decoded according to the modulation and coding scheme being used by the RF link using a processor that will, in effect, down-convert and filter the sampled FDM signal into separate baseband digital signals corresponding to different predefined channels within the band for detection of data that was transmitted. Similarly, a digital baseband signal (usually as in-phase and quadrature-phase signals) generated according to a particular modulation and coding scheme is used to modulate the phase and/or amplitude of a carrier frequency to transmit a signal. Generally, however, there will be an RF stage path for receiving and transmitting in each frequency band. The RF paths may, however, share components. The RF stage can be implemented using separate RF receiver and transmitter circuits, an integrated transceiver that handles both transmitting and receiving, or a combination.

Figure 6:
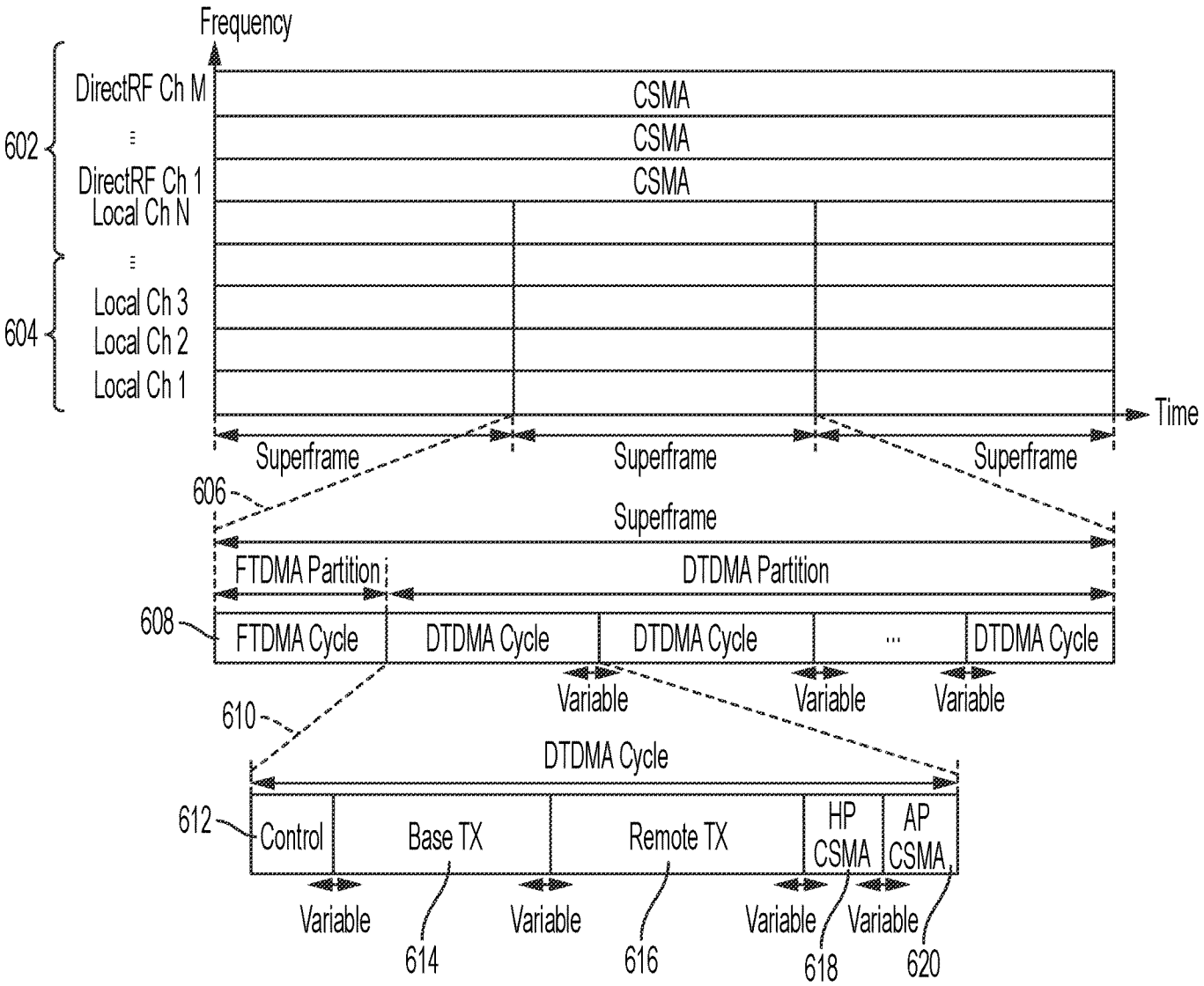
FIG. 6 illustrates the over-the-air protocol used by RF wireless segments of the ITCnet train control network.

Although not explicit in FIG. 5, the applications 500 in EOT area 202 and the HOT area 204 each include a messaging system component and a communications manager that selects from multiple available communication paths to select a path and forward an application message according to that path to the one or more radios in the area—the one or more EOT radios 502 or the one or more HOT radios 504—through other transports 506. FIG. 6 illustrates the over-the-air protocol used by the 220 MHz ITCnet train control network for the wireless transports for the communication paths that use the ITCnet 220 MHz frequency band. The protocol is also a representative example of, more generally, protocols for radio access networks, particularly interoperable ones, that can be used as a transport for EOT/HOT application messages and multiple paths over which to route an EOT/HOT application message using a wireless network as a transport.

A remote radio is any radio in the system other than a base station radio. ITCnet channels are categorized into two groups, namely local channels 604 and common or shared channels 602, which are referred to as DirectRF channels in ITCnet. A local channel is used to support traffic from all radios within a base station radio's coverage. Each local channel is centrally controlled by a base station radio based on a master-slave architecture, and each base station radio controls only one local channel. Each remote radio can listen to multiple base stations, but the remote can select only one base station to be its master; other base stations are considered as neighbor base stations of the remote. All wayside, locomotive, and other mobile radios communicating over ITCnet RF links are remote radios in ITCnet. Thus, any of EOT radios 502 and HOT radios 504 that are capable of communicating in the 220 MHz frequency band is considered a remote radio for the ITCnet radio access networks.

A DirectRF (common) channel in an ITC network is shared by every radio, both base and remote, using a carrier sense multiple access (CSMA) scheme. The common channel can also be used to support base beacon signals, which carry information necessary for a remote radio to identify and select a base station as well as to set up receive frequencies or channels for receiving transmissions from the base station.

A local channel is divided in time into periodically repeated superframes 606 of fixed duration. The superframe duration is the same for the entire network. The superframes are synchronized across all local channels. Each superframe consists of one fixed time division multiple access (FTDMA) cycle 608 and one or multiple DTDMA (Dynamic Time Division Multiple Access) cycles 610. The superframe starts with the FTDMA cycle, followed by the DTDMA cycles.

The FTDMA cycle is used to support periodic traffic that is repeated every superframe. The FTDMA cycle comprises multiple FTDMA slots. The FTDMA slots in an FTDMA cycle can have different slot sizes. One FTDMA slot is used to support one RF packet (also referred to as a packet or wireless packet). The FTDMA cycle repeats every superframe, and the size of each slot remains the same in every superframe.

DTDMA is a centralized access scheme where the channel is time-slotted, and the base station radio controls the allocation of time slots to users. Several TDMA (time division multiple access) slots are grouped into a DTDMA cycle of variable length. Each slot in the DTDMA cycle can be allocated for the transmission of an RF packet from the base or remote. A slot for transmission by a remote radio could be assigned to a particular remote radio or set as a contention slot. The contention slots are not assigned to specific remote radios but allow remotes to get access to the channel through a slotted CSMA (Carrier Sense Multiple Access) scheme. Slots in the DTDMA cycle could have different lengths. The DTDMA slot assignment, including slot size and the user to whom the slot is assigned, is controlled by the base station. Specifically, the DTDMA slot assignment is performed by a scheduler at the base station radio based on transmit queue information from the base station radio and the remote radios. The DTDMA slot assignment is broadcast by the base station radio in a DTDMA control packet, which is sent at the beginning of the DTDMA cycle.

For purposes of enabling the scheduler to obtain knowledge of a remote radio's transmit queue, the access scheme may, optionally, provide for a remote radio to send an update of its transmit queue information to the base station radio. For example, in one exemplary implementation, a remote radio may transmit its current queue information in the assigned DTDMA slot or in the contention slot. At the end of each DTDMA cycle, the scheduler may, optionally, use the queue information that it receives from any one or more of, or all, the remote radios or users to determine the allocation of slots in the next DTDMA cycle.

The DTDMA cycle is used to support traffic from the base station radio and remote radios that are connected to the base. At the beginning of each DTDMA cycle, the base station broadcasts a DTDMA control packet that organizes the transmissions in the DTDMA cycle. Following the DTDMA control packet is the data traffic from the base and remotes.

As a train moves along a track, a remote radio in the EOT area and a remote radio in the HOT may each register with a base station. The remote radios may register with the same base station or with different base stations. A remote radio may switch its connection to a new base station as the train moves by registering with the new base station. Registration involves sending a wireless packet to a base station that contains the radio ID of the remote radio. The registration may result in either a connectionless registration or a connection with the base station. The base station then stores the radio ID of the remote radio in a routing table. Each 220 MHz radio is assigned a unique fixed identification code that is used as a fixed network address by ITCnet. An entry in the routing table indicates that the base station can reach the remote radio. A remote radio may register with a serving base station radio by requesting the base station to connect by, for example, the remote radio sending an "Acquire" packet to the base station. This initiates a connection setup process at the base station that establishes a link between the base station and the remote radio. A connection usually includes the assignment of a transmission slot in a DTDMA cycle.

Figure 7:
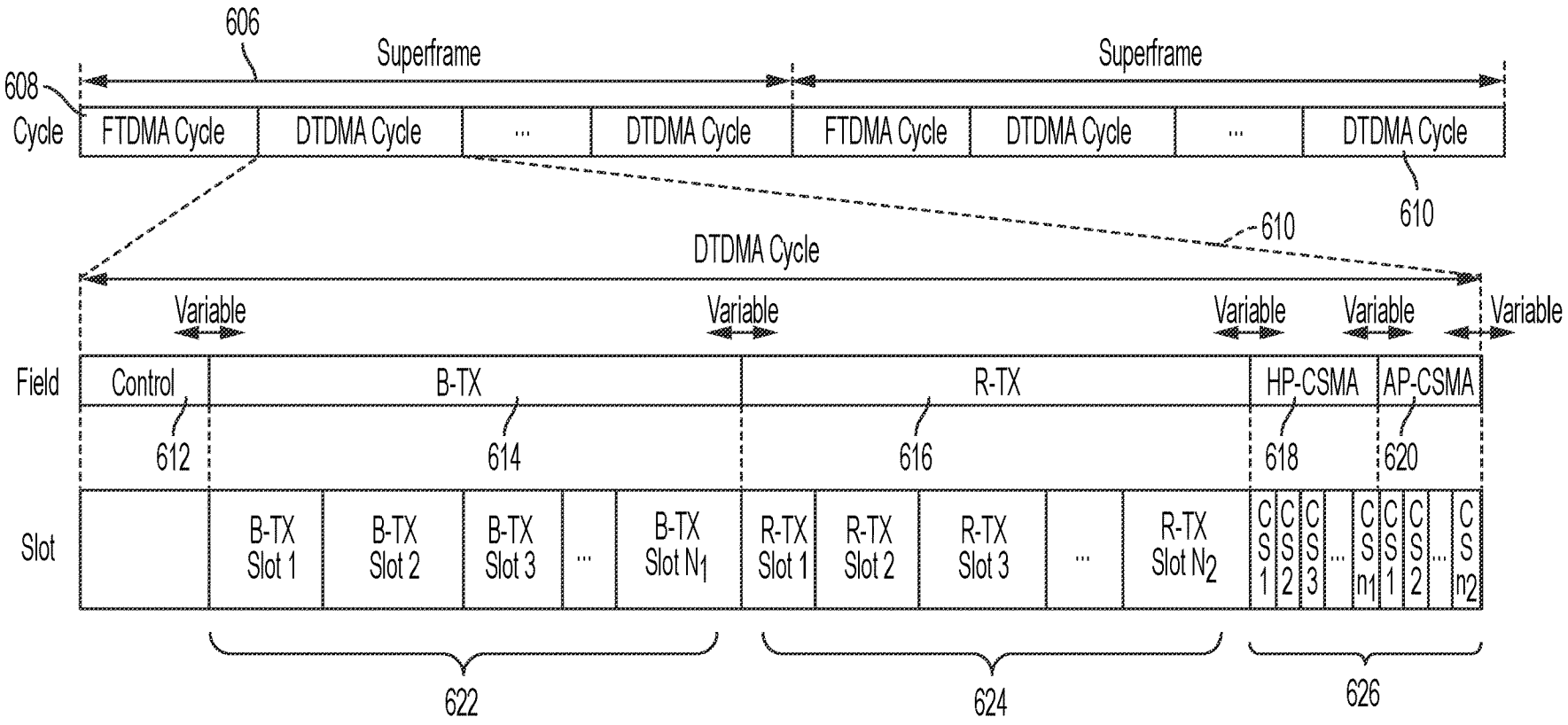
FIG. 7 illustrates the structure of a DTDMA cycle of the over-the-air protocol of FIG. 6.

FIG. 7 illustrates the structure of the DTDMA cycle. The DTDMA cycle consists of 5 different fields, including the control field 612, which specifies the DTDMA cycle structure; a base transmit (B-TX) field 614, which is used to carry outbound data traffic from the base station radios to remote radios; remote transmit (R-TX) field 616, which is used to carry inbound data traffic from remote radios to base station radios; a high-priority CSMA (HP-CSMA) field 618, which is reserved for a remote radio with high-priority data to get access to the local channel; and an all-priority CSMA (AP-CSMA) field 620, which is used for any remote radios to get access to the channel. Each field in any of the DTDMA cycles 610 is of variable length. Each field, except the control field, comprises DTDMA slots of one type. There are three DTDMA slot types: base transmit (B-TX) slots 622, remote transmit (R-TX) slots 624, and CSMA slots 626.

A communications manager in the EOT area obtains from a 220 MHz remote radio in the EOT area information about connections that the remote radio may have with a base radio. Similarly, a communications manager in the HOT area obtains from a 220 MHz remote radio in the HOT area information about each connection of the remote radio with a base radio and each connection with a remote radio, such as the remote radio in the EOT.

Figure 8:
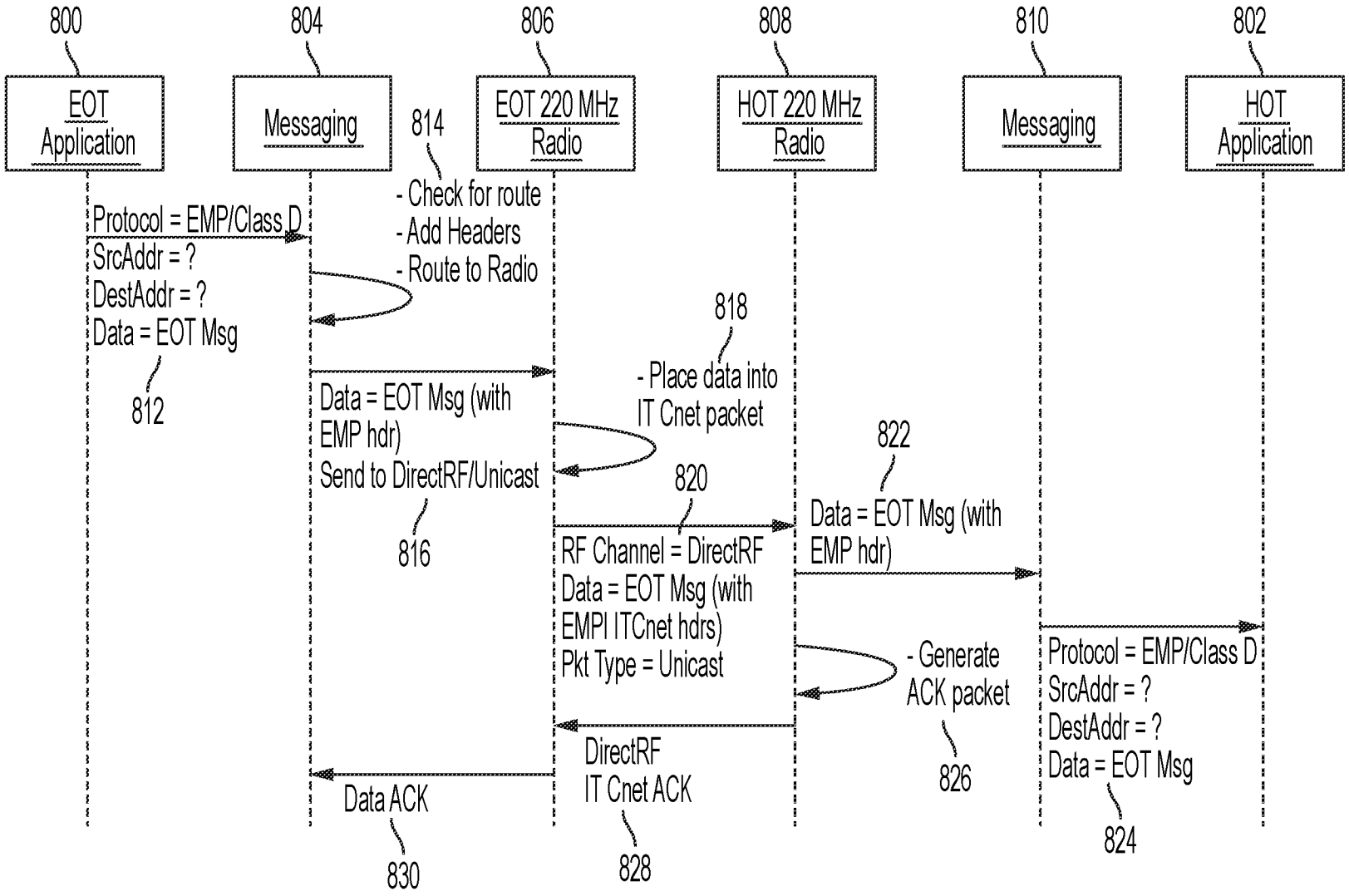
FIG. 8 is a flow diagram of a representative example of a process of transporting a message from an EOT application to a HOT application over a direct RF link.
Figure 9:
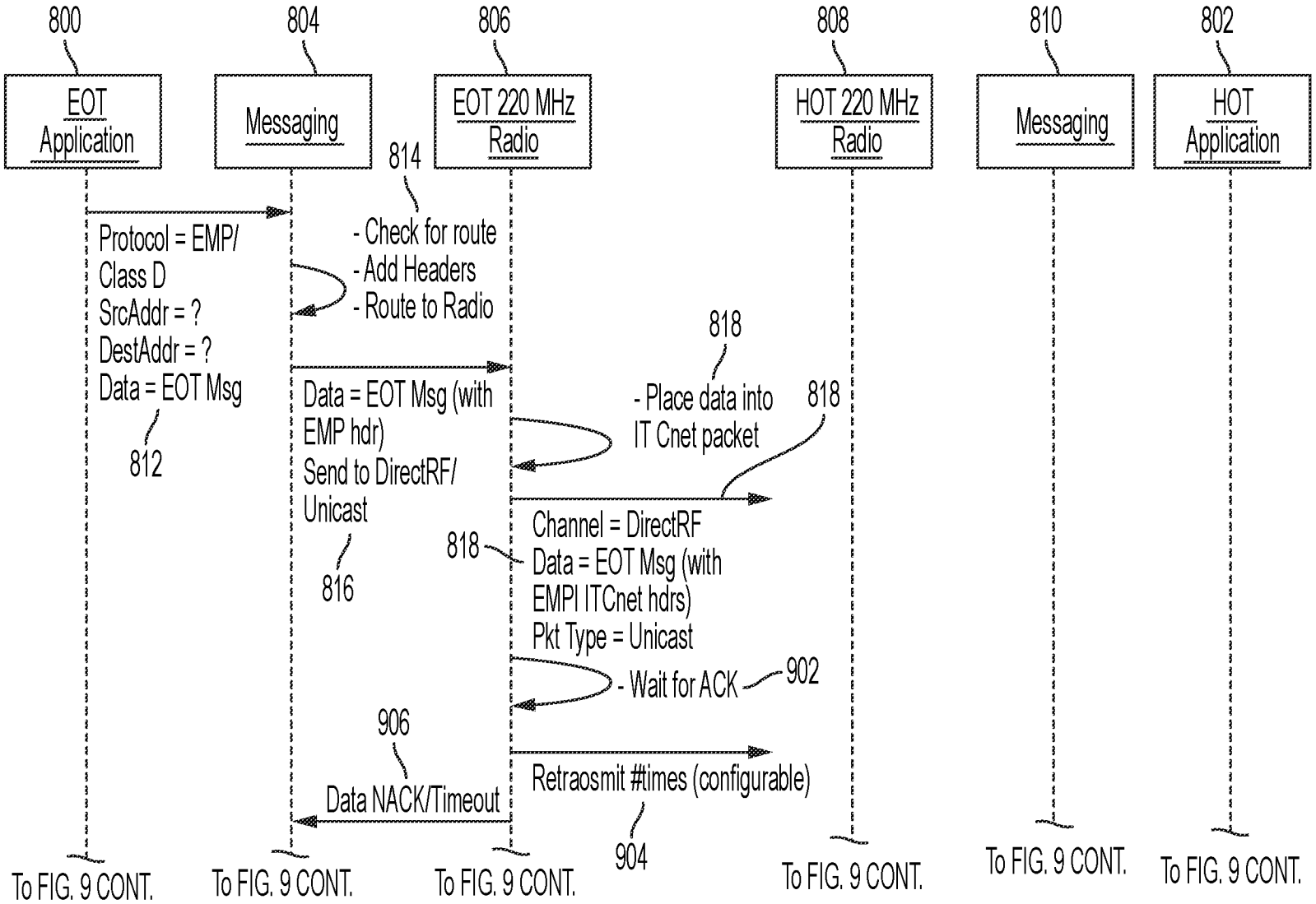
FIG. 9 is a flow diagram of a representative example of a process of transporting a message from an EOT application to a HOT application over RF links through a repeater.
Figure 9:
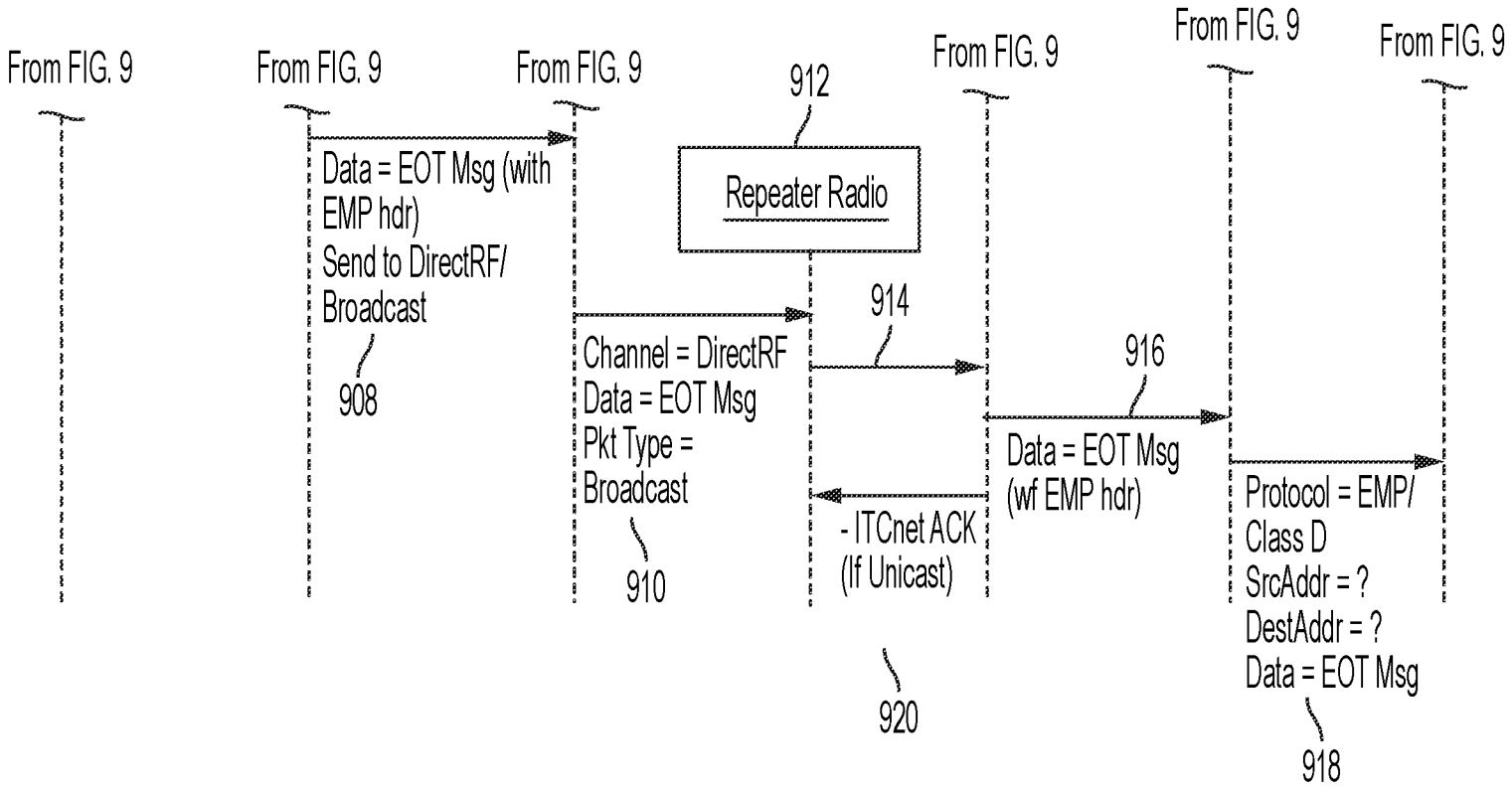
Figure 10A:
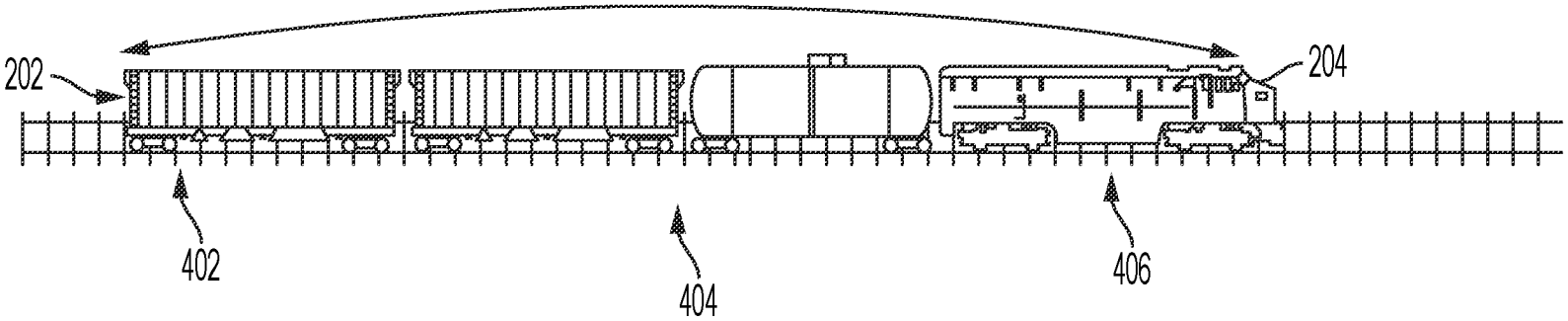
FIG. 10A illustrates various communication paths using RF links that are possible when using a base station radio as a repeater.
Figure 10B:
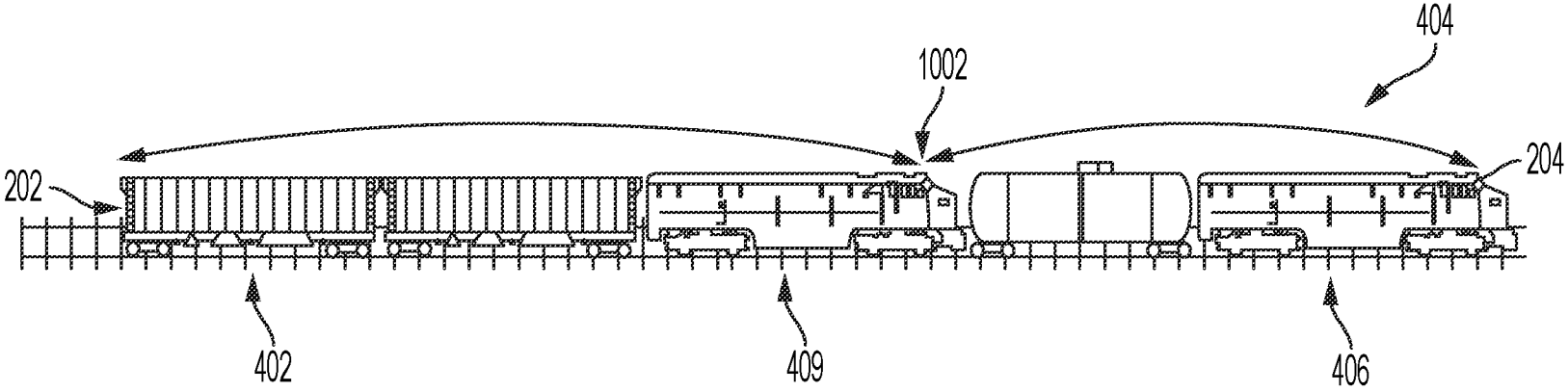
FIG. 10B illustrates a communication path between EOT and HOT areas using RF links through a repeater that is a remote radio in an intermediate locomotive in the same train.
Figure 10C:
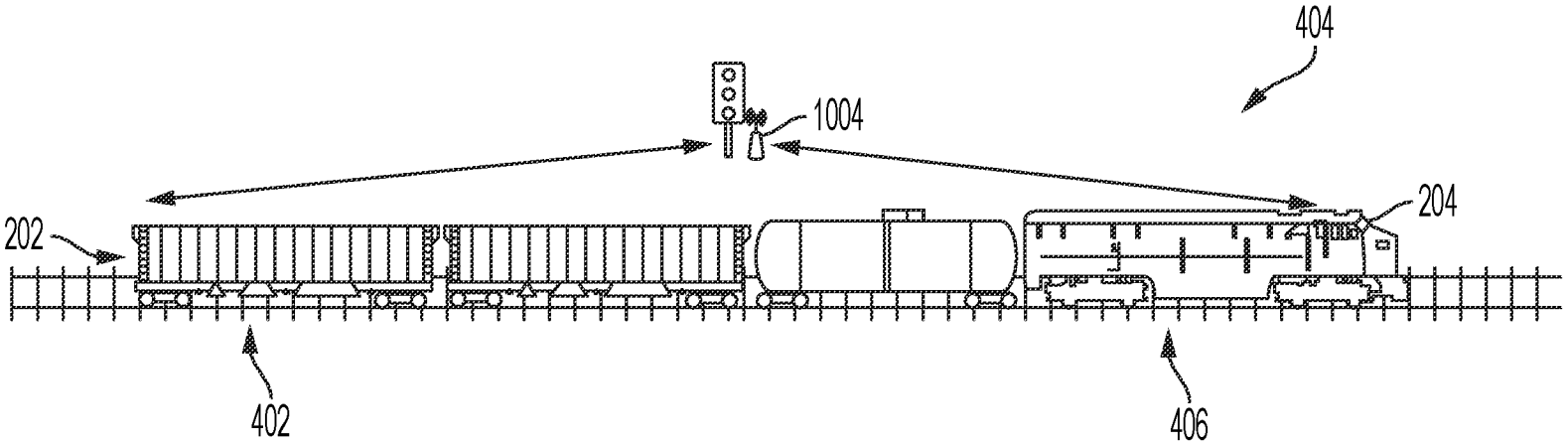
FIG. 10C illustrates a communication path between EOT and HOT areas using RF links through a repeater that is a wayside remote radio.

FIGS. 8 and 9, which are described in further reference to FIGS. 10A-10C, illustrate representative examples of processes for a communication path in which an EOT/HOT application message is sent by an application 800 in the EOT area 202 (the EOT application) to an application 802 in the HOT area 204 on a direct wireless path between an EOT 220 MHZ radio 806 and a HOT 220 MHz radio 808, as represented by FIG. 10A, and an indirect wireless-only path through an intermediate 220 MHz remote radio acting as a repeater. FIG. 10B illustrates a process in which a 220 MHz radio 1002 in an intermediate locomotive 409 acts as a repeater. FIG. 10C illustrates an example of a process in which a 220 MHz radio 1004 at a wayside between the HOT and EOT areas acts as a repeater.

For purposes of illustration only, the representative examples of message flows in FIGS. 8 and 9 and the other message flows described below will use an EOT application as the originating EOT/HOT application for a message. The message flows would be substantively the same for a message being sent by a HOT application to an EOT application.

The EOT application 800 generates and forwards to a messaging system component 804 an application message at step 812. The application message comprises application data wrapped in an EMP envelope. A Class D header is added to transport the application message within the EOT area over a TCP/IP connection established on the local area's network to the EOT to the local messaging system component 804. The local messaging system component 804 comprises, in this example, one or more programmed processes executing on a computing device that implement gateway functions of the ITCM messaging system. When the processes of the EOT messaging system 804 receive the application message over a connection set up for application messages to be delivered to an application in the HOT, it checks its routing tables for routes to the HOT messaging system, adds the source and destination EMP addresses for the EOT and HOT areas, selects a path, adds TCP/IP headers according to the path, and routes the application message with headers at step 816. In this example, the selected path is a unicast wireless packet addressed to a 220 MHz radio 808 in the HOT area that is transmitted by a 220 MHz radio 806 in the EOT area over a direct RF channel. At step 816, it forwards within the EOT area to the EOT 220 MHz radio 806 the application message in one or more packets over a Class D TCP/IP connection between the communications manager and EOT 220 MHz radio 806 for transmission in one or more unicast wireless packets to the HOT 220 MHz radio 808 in direct RF channel. This connection was previously set up between the communications manager in the EOT and the EOT 220 MHz radio 806.

When the packet (or packets) is received by the EOT 220 MHz radio 806, it places at step 818 the application message into one or more unicast wireless packets addressed to the HOT 220 MHz radio 808 with a payload that contains the application message (the message data inside the EMP envelope) and, optionally, additional data and transmits it over a selected DirectRF channel at step 820.

A 220 MHz remote radio always listens to the DirectRF channels when it is not transmitting. A packet transmitted in a DirectRF channel can be a unicast packet or broadcast packet. A unicast packet will include the radio identifier of the transmitting radio and the destination radio to which the unicast packet is being sent. Unicast packet transmission is typically specified at least for an initial attempt to route an application message. If the packet is a broadcast packet, a destination radio address is not specified. The destination radio will not know to respond to a broadcast after successfully receiving the packet. Therefore, the source radio will not know whether the packet was received successfully. Transmitting as a unicast packet is therefore preferred but not required.

Referring now only to FIG. 8, if the destination radio, which is the HOT radio 808 in this example, successfully receives at step 820 the unicast wireless packet, it removes the data at step 822, which is the EOT message with EMP header, then routes the application message over a Class D TCP/IP connection to the HOT messaging system 810. The messaging system 824 then determines from the destination address in the EMP header whether the application is intended for it and, if so, routes the application message to the destination HOT application 802 at step 824.

Upon receipt by the HOT 220 MHz radio of the unicast packet, the radio responds by generating at step 826 and transmitting at step 828 in the same direct RF channel a unicast acknowledgment (ACK) packet addressed to the EOT 220 MHz radio 806 to acknowledge that it received the wireless packet. For example, if the source radio transmits in DirectRF channel "i," the destination radio transmits the ACK packet in DirectRF channel i. When the EOT 220 MHz radio 806 receives the acknowledgment packet, it sends a message at step 830 to the EOT messaging system 804.

Referring now to FIG. 9, if the EOT 220 MHz radio 806 (the transmitting radio) does not receive a response from the destination within a prescribed waiting period, as indicated by step 902, the transmitting radio assumes that the unicast packet is lost. The destination radio may, for example, be configured to automatically retransmit the unicast packet at step 904 in response to the period for response timing out, as indicated by step 904. If it is not configured to retry, or the retry is not successful, the EOT 220 MHz radio 806 sends a message at step 906 to the messaging system 804 that indicates the time for an acknowledgment to the unicast packet has expired (a "NACK/Timeout" message). In response to receiving the NACK/Timeout message, the EOT messaging system 804 then determines a next action step. Optional next options may include trying again to route the application message along the same path or selecting a new path for routing the application message.

In this example, the messaging system 804 determines to route the message by broadcasting it on the EOT 220 MHz radio 806 so that it can be repeated by a 220 MHz radio located between the EOT and HOT. At step 908, the EOT messaging system routes the message over a TCP/IP connection with the EOT 220 MHz radio 806 for transmitting a broadcast type of wireless packet in a DirectRF channel.

When the application message is received by the EOT 220 MHz radio 806, it transmits at step 910 the application messages as the payload in one or more broadcast messages. In this example, the one or more broadcast packets are received by repeater radio 912. The repeater 912 retransmits the payload of the broadcast packet in either a broadcast wireless packet or, if it has a route to the HOT 220 MHz radio 808, as a unicast message in the same DirectRF channel as indicated by step 914.

It is preferred, though not required, that a repeater radio not repeat a message that has already been repeated. This will reduce the risk of loops that might overload the communications system. The wireless packet sent by the repeater radio, therefore, includes the radio ID of the transmitter, the radio ID for the destination radio, and the radio ID of the originating radio. Therefore, a repeater radio is able to determine whether the wireless packet has already been repeated. If a repeater radio determines that the wireless packet has been previously repeated, it may choose not to repeat it.

When either a unicast message or a broadcast message is received by the HOT 220 MHz radio 808, the radio removes the application message from the wireless packet and forwards it at step 916 to the HOT messaging system 810. If the application message is addressed to the HOT area, the HOT messaging system handles the application message in the same manner as described above for a unicast packet. If the wireless packet is a unicast packet, the HOT 220 MHz radio 808 will send at event 920 a wireless acknowledgment packet to repeater radio 912.

Examples of possible situations involving a repeater 220 MHz radio are shown in FIGS. 10A to 10C. In FIG. 10A, the repeater is a base station radio 412 or 416. FIG. 10B illustrates the situation in which the repeater is a 220 MHz remote radio 1002 in locomotive 409 positioned between the lead locomotive 406 and the end car 402. FIG. 10C illustrates the use of a 220 MHz remote radio 1004 of a wayside as a repeater.

A message originating in the HOT area and sent to the EOT area is handled substantially the same way.

Figure 11:
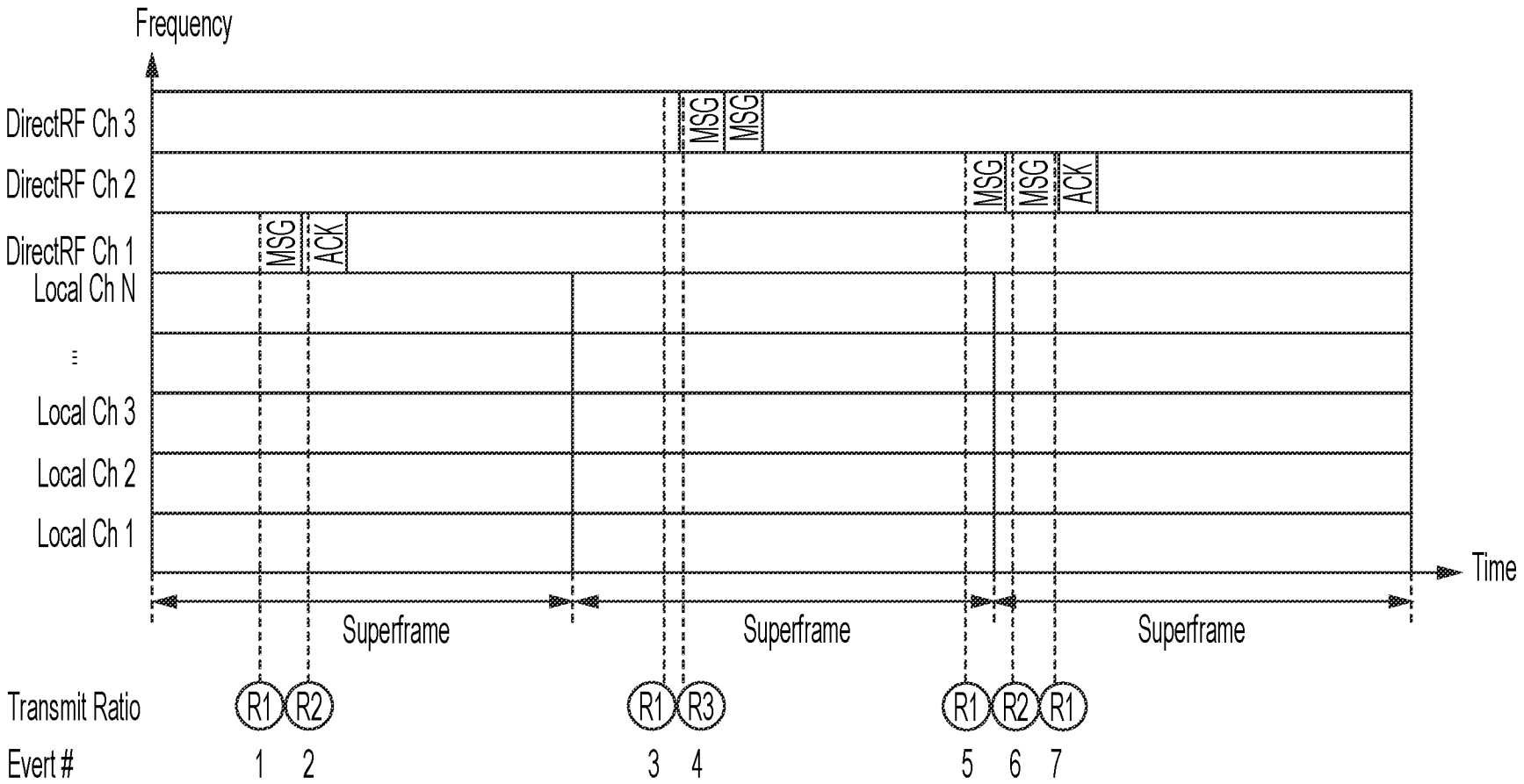
FIG. 11 illustrates an example of a representative method of an EOT/HOT communications system handling interfering messages on a direct 220 MHz communication path.

FIG. 11 illustrates an example of how an EOT and HOT communicate over a 220 MHz direct communication path, such as the one described in connection with FIGS. 8 and 9 may handle interfering messages. In the figure, one of the transmit radios, labeled R1 and R2, is a HOT 220 MHZ radio, and the other is an EOT 220 MHz radio. Radios R1 and R2 are thus remote radios, meaning that they are not base station radios. R3 is another remote radio near the R1 and R2 remote radios.

At event 1, the R1 transmits a message to R2 in DirectRF channel 1. Event 2 is the R2 acknowledging the message reception by sending an ACK packet to R1 in the same DirectRF channel, which is DirectRF channel 1. R1 then transmits a message to R2 in DirectRF channel 3, which is event 3. Event 4 is the transmission by R3 of a message at close to the same time as the R1 transmission (event 3). Consequently, the transmissions from R1 and R3 on the DirectRF channel 1 collide or interfere with each other, resulting in R2 not receiving the packet transmitted by remote R1. R1 then attempts again to send the same message by transmitting it to R2 in DirectRF channel 2, which is event 5. R2's response, which is event 6, is to transmit a response message to R1 in the same DirectRF channel, DirectRF channel 2. The response message also serves to acknowledge receipt of the R1 message. Event 7 is the R1 acknowledging that it has received R2's message by sending an ACK packet to R2 in the same DirectRF channel, DirectRF channel 2.

As previously disclosed, the EOT-HOT communication system may also transport an application message on indirect paths through one or more backhaul and interconnecting networks using base stations of a wireless transport network.

Figure 12:
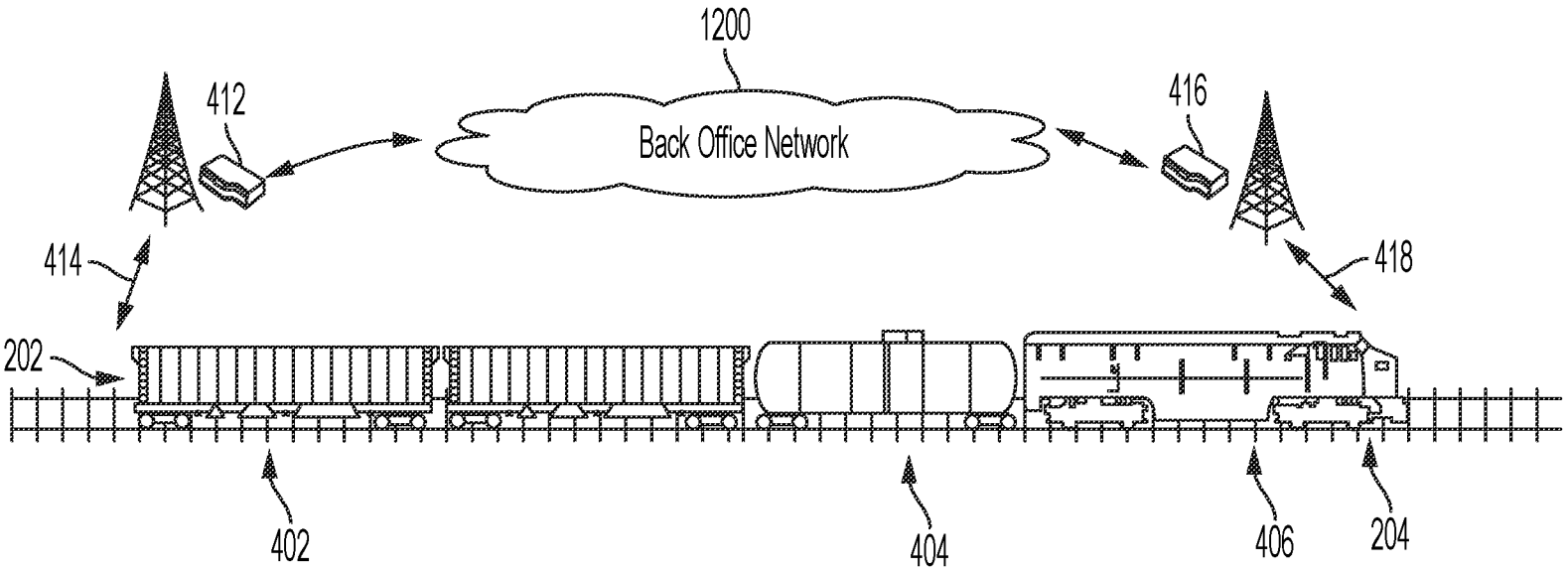
FIG. 12 is a diagram representing an indirect communications path through one or more back-office networks connected with a train control network.

FIG. 12 illustrates an example of an indirect communications path through one or more back-office networks 1300 that connect with base stations 412 and 416 of an interoperable train control network. ITCnet is used as a representative example of a train control network that can be used to transport application messages using a messaging system—the ITCM messaging system in this example—between applications in the EOT and HOT areas. The EOT area 202 on the last car 402 of train 404 has a radio that communicates with base station radio 412, as represented by wireless link 414. The HOT area 204 of locomotive 406 has a radio that communicates with base station 416, as represented by wireless link 418. Application messages are routed through one or more back-office networks 1300.

Figure 13:
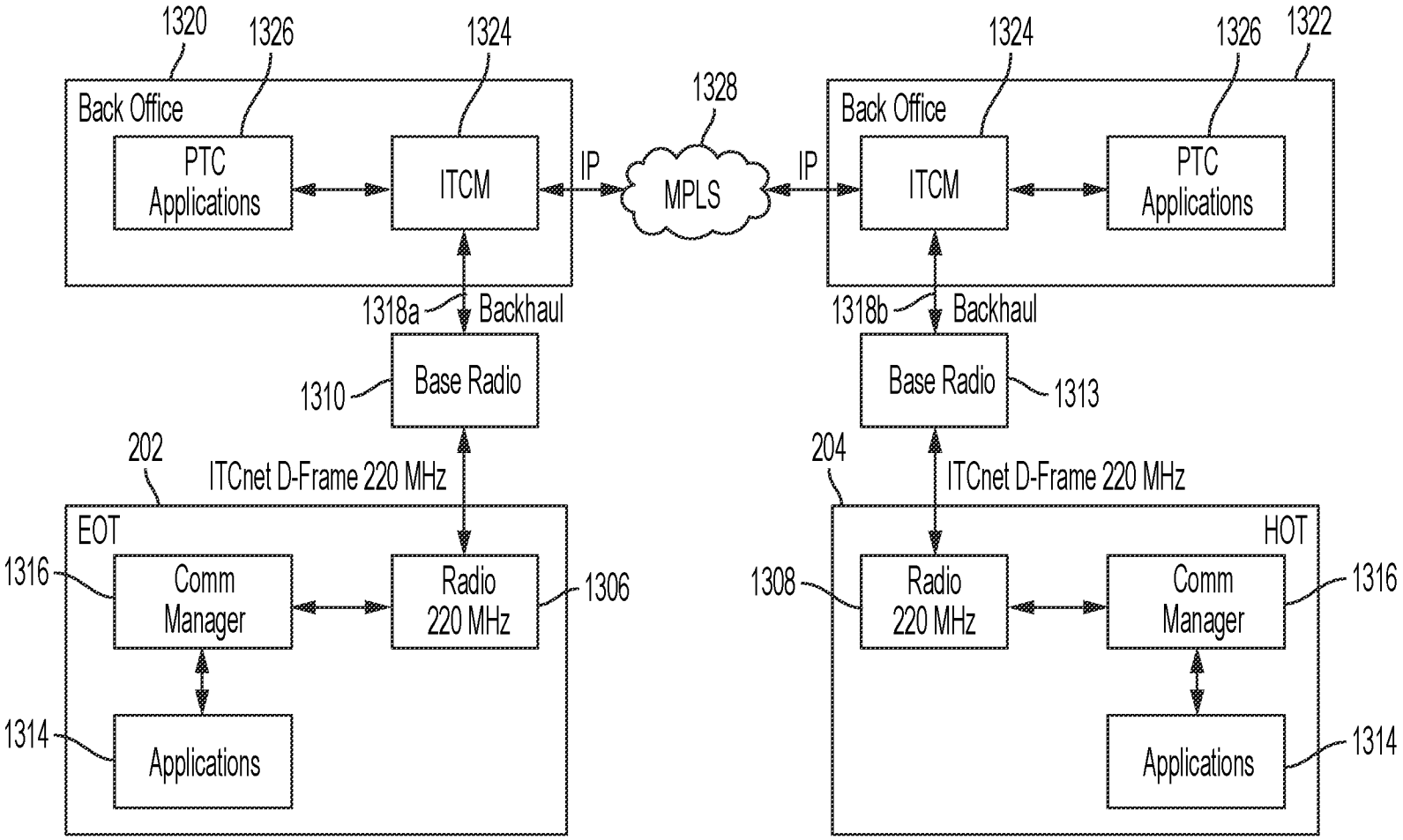
FIG. 13 is a block diagram of the computer processes, radios, and communication segments of a train control network using ITCnet as an example.

FIG. 13 is a block diagram of examples of applications, radios, and communication segments involved in implementing an indirect communication path between EOT and HOT applications 1214 through a train control network, which in this example is the ITCnet 220 MHz radio network. The EOT area 1302 has a radio 1306, and the HOT area 1304 has a radio 1308, each of which is configured to operate in at least a 220 MHZ frequency band using the ITCR protocol. Although shown to be connected to different base radio station radios, 1310 and 1313, respectively, the EOT radio and the HOT radio may also connect to the same base station radio, a scenario discussed below. An application message from a remote application 1314 at one end of the train (the EOT or HOT) is routed to a communications manager 1316. The communications manager selects a path and routes the application message.

In the illustrated example, the EOT and HOT radios each have a connection to a base station radio 1310 that can serve as a path for routing an application message using the ITCM messaging system. When a remote radio is connected to a base station, the remote radio transmits wireless packets in an R-TX slot in the DTDMA portion of the local channel of the base station. If the remote radio does not get assigned an R-TX slot from the base station, the remote radio can send a slot request message to the base using the CSMA part of the local channel. The wireless packet transmitted can be a broadcast or unicast packet. There is no acknowledgment for the broadcast packet. For a unicast packet, the base acknowledges the reception of the packet by sending an acknowledgment in the control packet of the next DTDMA cycle. If the base does not receive the packet, the base assigns another R-TX slot to the remote in the next DTDMA cycle. If the remote does not receive the acknowledgment, it will assume that the packet is lost and retransmit the packet in the next assigned R-TX slot.

Each of the base station radios, 1310 and 1313, communicate, respectively, to a different back office, 1320 and 1322, through backhauls 1318*a* and 1318*b*. A back office represents a different domain that owns or manages applications, such as "PTC Applications" 1326, that are used to control and monitor the movement of trains and/or to provide other train-related application services. Each back office has components of an ITCM messaging system represented by a messaging system gateway 1324. Two back offices, 1320 and 1322, illustrate the possibility, not the requirement, that the EOT and HOT can be connected to different base station radios that are each connected to a different back office network. ITCM messaging system components in each back office may be connected to exchange application messages by, for example, one or more interconnected IP networks 1328 that support MPLS (multiprotocol label switching). This capability supports interoperability. An MPLS IP network allows dedicated paths to be set up through the IP networks for reliable exchange of application messages between ITCM gateways. However, an IP network using MPLS is not required to connect the back offices. Furthermore, although not illustrated, the two base radios, 1310 and 1313, may connect to the same back office.

As previously described, when an EOT or HOT application 1314 (see FIG. 13) generates an application message (message data inside of an EMP envelope), it sends it to the communication manager 1316 for the area (EOT or HOT.) The communications manager checks for a route and selects a path to route the application messages. In the scenario of FIGS. 12 to 15, the selected path is through a connection to an ITCnet base station for routing by the ITCM messaging system through one or more back offices. The communications manager, therefore, forwards the message over a connection that it has with the 220 MHz radio in its area (the EOT 220 MHz remote radio 1310 or the HOT 220 MHz remote radio, as the case may be) for transmitting application messages to a base station radio with which the remote has a connection. In other scenarios, the connection manager might select, if available, a connection to the 220 MHz radio for transmission of an application message on one or more direct or indirect wireless paths to the other area or another path that does not use a 220 MHz transport, such as a legacy 450 MHz radio or another IP transport.

After the successful reception of the message by the base station radio B1, the base station forwards the application message over the backhaul transport network 1318*a* to the ITCM gateway 1324, with which it has a connection. The ITCM gateway then determines a route for forwarding the message to the destination application for the message based on the destination address in the EMP header in the message. The message is forwarded to the base station radio that has a connection to the destination radio. This might require routing the message through an ITCM gateway at another back office. Furthermore, the base station can be the same or a different base station from the base station that received the message from the source. When the base station receives the application message, it schedules it for transmission to the remote radio located in the destination area. This involves, in the ITCnet system, scheduling a remote B-TX slot(s) in the DTDMA cycle for transmitting one or more wireless packets containing the message. The base station then transmits the message in one or more wireless packet(s) to the destined remote radio in the reserved slot or slots. For each unicast packet, the base also schedules a slot in the next DTDMA cycle for the destined remote radio to acknowledge the reception of the packet.

Figure 14:
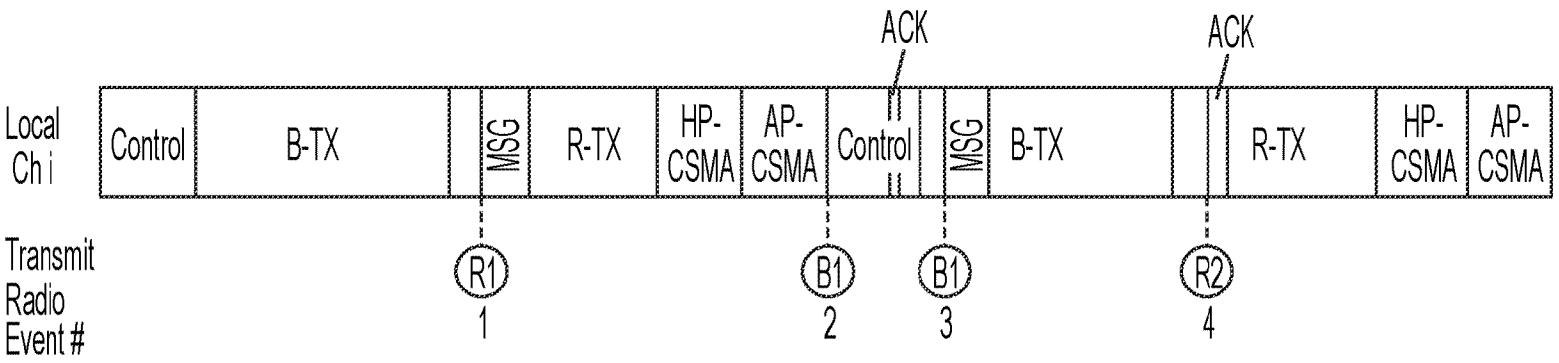
FIG. 14 schematically illustrates an example of an event timeline for an indirect communications path for transporting an application message through a back office where an EOT radio and HOT radio connect to the same base station.
Figure 15:
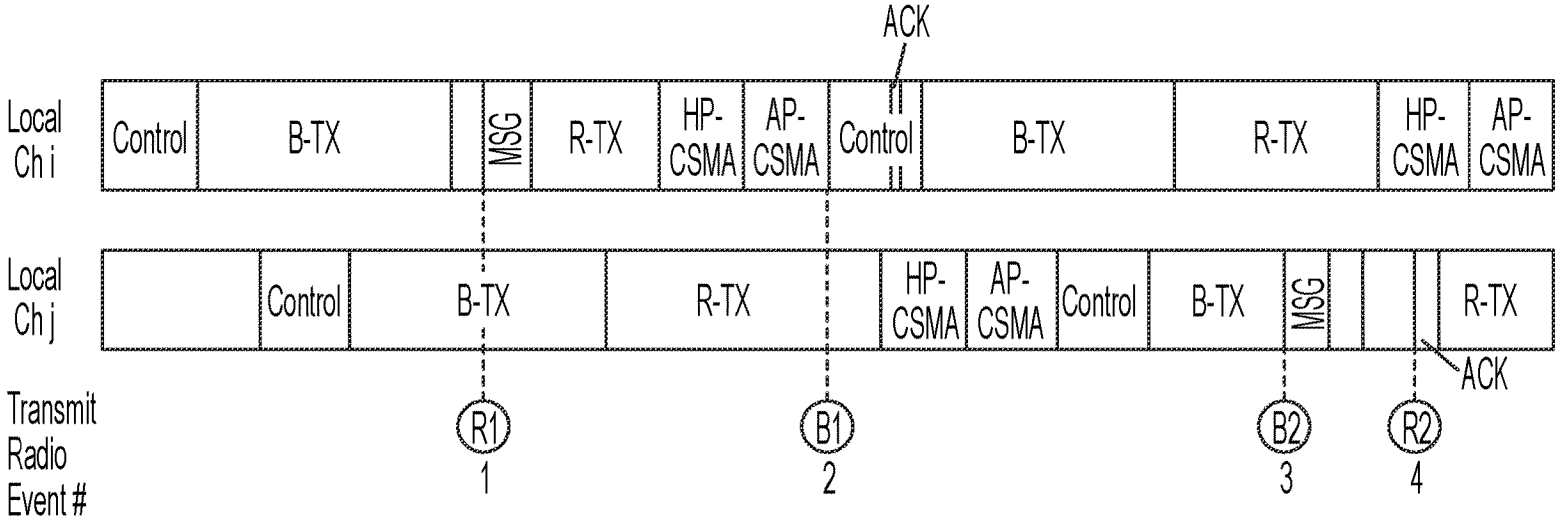
FIG. 15 schematically illustrates an example of an event timeline for an indirect communications path for transporting an application message through a back office where an EOT radio and HOT radio connect to different base stations.
Figure 16:
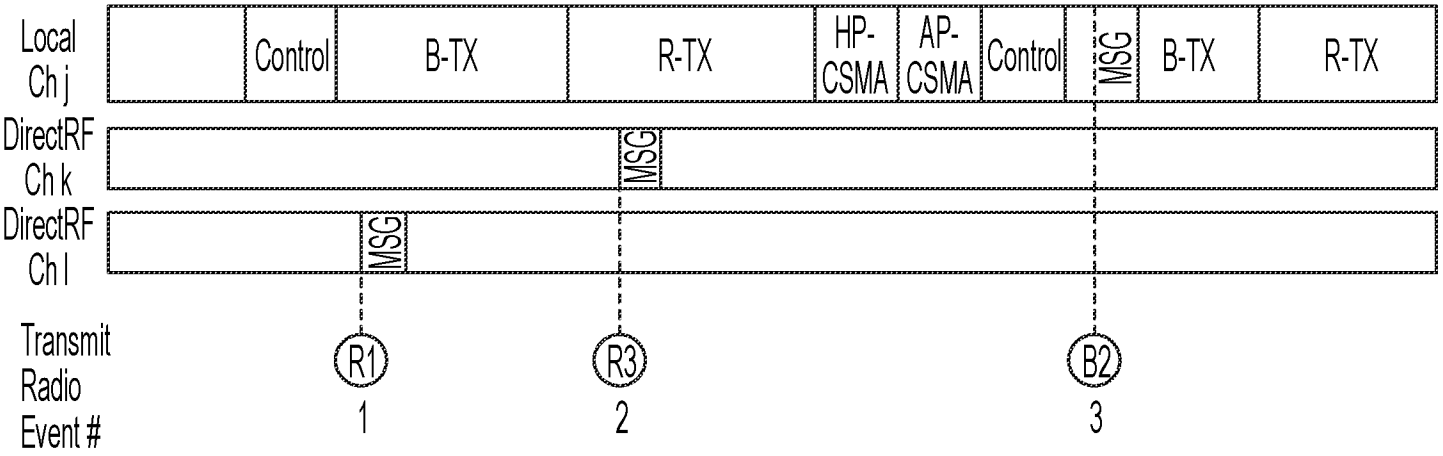
FIG. 16 schematically illustrates an example of an event timeline for a wireless communications path through a repeater and a base station.

FIGS. 14-16 are representative examples of event timelines in which a communications manager selects indirect (FIGS. 14 and 15) and direct communication paths for an EOT/HOT application message using 220 MHz ITCnet as a transport. In the figures, remote radio R1 is the originating 220 MHz remote radio, and remote radio R2 is the destination 220 MHz remote radio.

When a remote radio R1 receives from a communications manager to which it is connected an EOT/HOT application message for transmission, it packages the EOT/HOT application message into a wireless packet for transmission according to the path selected by the communication manager.

R1 would be, in the example shown in FIG. 13, the EOT remote radio 1306 if the application message originated in an application in the EOT area 202, B1 would be base station radio 1310 (the origination base station), R2 (the destination radio) would be the HOT 220 MHz remote radio 1308, and B2 would be base station radio 1313 (the destination base station). If the application originated from an application in HOT area 204, R1 would be the HOT 220 MHz remote radio 1308, R2 would be the EOT 220 MHz remote radio 1306, B1 would be the base station radio 1313, and B2 would be base station radio 1310. Note, however, that in the scenario of FIG. 14, both the R1 and R2 are connected to the same base station B1. This scenario is not shown in FIG. 13.

In the scenarios of FIGS. 14 and 15, the remote radio R1 packages the EOT/HOT application message into one or more wireless data packet(s) to transmit the message to a base station radio "B1," with which it has a connection. When remote radio R1 and remote radio R2 are connected to the same base station B1, such as in the scenario of FIG. 14, the remote radios R1 and R2 will be communicating with the same base station B1 using the same local channel, which the base station B1's local channel "i." If the remote radios R1 and R2 are connected to different base stations B1 and B2, respectively, the local channel for B1 will be local channel "i" and will be used for transmissions between remote radio R1 and base station radio B1 sent using a connection established between the base station radio B1 and the remote radio R1. Local channel "j" is the local channel for base station B2, which will be used for transmitting wireless packets between the base station radio B2 and any radio with which it has a connection, which would be remote radio R2 in the scenario of FIGS. 15 and 16.

Referring now only to FIG. 14, the transmission from R1 to B1 is event "1." R1 transmits the application message in a unicast wireless packet B1 in an assigned R-TX slot of the DTDMA cycle of the base station's local channel "i." The message is routed from base B1 to a back office. Because R2 is also connected to B1, transmission from B1 of the EOT/HOT application message to remote radio R2 is scheduled by base radio B1. Event 2 is the transmission from B1 of an ITCnet control packet at the beginning of the next DTDMA cycle. The control packet carries an ACK field that acknowledges the reception of the wireless packet from remote R1. The control packet also includes slot assignment, which assigns the B-TX slot for B1 to transmit the packet to the R2 and an R-TX slot for R2 to acknowledge the reception of the packet. Event 3 represents B1 transmitting the application message to R2 using a unicast wireless packet in the previously assigned B-TX slot of the DTDMA cycle in B1's local channel. At event 4, remote radio R2 sends an ACK packet to B1 in the previously assigned R-TX slot of the DTDMA cycle in base station B1's local channel "i."

Referring now only to FIG. 15 is an example of an event timeline where R1 and R2 are connected to different base stations, which are labeled B1 and B2, respectively. The events are like those of FIG. 14, except that the message is transmitted to remote R2 by a base B2. At event 1, the remote R1 transmits a message packet to base B1 in an assigned R-TX slot of the DTDMA cycle in the base station's local channel "i." Event 2 is base B1 transmitting a control packet in the channel "i" at the beginning of the next DTDMA cycle. The control packet carries an ACK field that acknowledges the reception of the packet from the R1. Upon receipt of the message, base B1 sends the message over a backhaul to the ITCM messaging system components in the back office with which it is connected, which then routes the application message over IP message transports to B2 directly or through one or more other back-offices. B2 uses local channel "j." Upon receipt of the message, B2 assigns a B-TX slot in channel j for base B2 to transmit a wireless unicast packet with the application message to R2 and an R-TX slot for R2 to acknowledge the reception of the packet. These assignments are included in the control packet that is sent at the beginning of the DTDMA cycle of local channel j. Base 2 then transmits the message in the B-TX slot of the DTDMA cycle in the local base channel j, which is event 3. Event 4 is the remote R2 responding to the reception of the message by sending an ACK packet to the base B2 to acknowledge receipt in the following R-TX slot.

FIG. 16 illustrates a scenario in which a communications manager in either the EOT or the HOT area (the originating area) at one end of the train selects a direct transmission to the other area (the destination area) at the other end of the train. The communications manager in the originating uses remote 220 MHz radio R1 in the originating area to send the application message to remote radio R2 in the destination area at the other end of the train. Event 1 represents R1 transmitting on DirectRF channel "i" a wireless packet addressed to remote radio R2. In this scenario, there is a radio R3, such as a remote radio on a locomotive between the head and end of the train or at a wayside that the train is passing, that receives the message in DirectRF channel "i" and is configured to repeat DirectRF wireless packets that it receives that are not addressed to it unless it has already transmitted the wireless packet. It transmits the wireless packet received from remote radio R1 in DirectRF channel "k," which is represented by event 2. A base station B2 that has a connection with R2 receives the wireless packet transmitted by R3. It is configured to check its routing table to check for a route to a radio ID specified as the destination address in a wireless packet received on a DirectRF channel. In this scenario, it has a connection with remote radio R2. A remote radio in a HOT typically always tries to maintain a connection with a base station for the purpose of train control. A remote radio in the EOT may not. Event 3 represents the base station radio B2 transmitting the wireless packet received from remote radio R3 to remote radio R2 using a local channel controlled by the base station. In this example, it is transmitted in a "B-TX" slot in channel "j" that the base station B2 assigned for transmission to R2.

As previously mentioned, a communications manager in the EOT or HOT area may select, if available, a path that does not use a 220 MHz transport, such as a path between 450 MHz radios in each area using the legacy protocol for end-of-train communications, which is defined in Association of American Railroads (AAR) Manual of Standards and Recommended Practices (MSRP) Section K-II, Locomotive Electronics and Train Consist System Architecture, S-9152 V2.1— End of Train Communications. For this path, a radio in the HOT is configured to transmit in the 452.9375 MHz channel, while a radio in the EOT is configured to transmit in the 457.9375 MHz channel. When a 450 MHz radio has a message to transmit, the radio transmits the message in the configured channel. There is no collision avoidance mechanism in the legacy 450 MHz protocol. The same 450 MHz transport could be used with an advanced communication protocol if both the EOT and HOT MHz radios are configured to support it. The advanced protocol would be another possible path that could be selected by a communications manager if the radios in the HOT and EOT support it.

As previously mentioned, a communications manager may further be configured to select from one or more paths over other wireless IP networks that are available to transport ITCM application messages as described in the published standard for ITCM. Examples include cellular, WIFI, and satellite networks.

Figure 17:
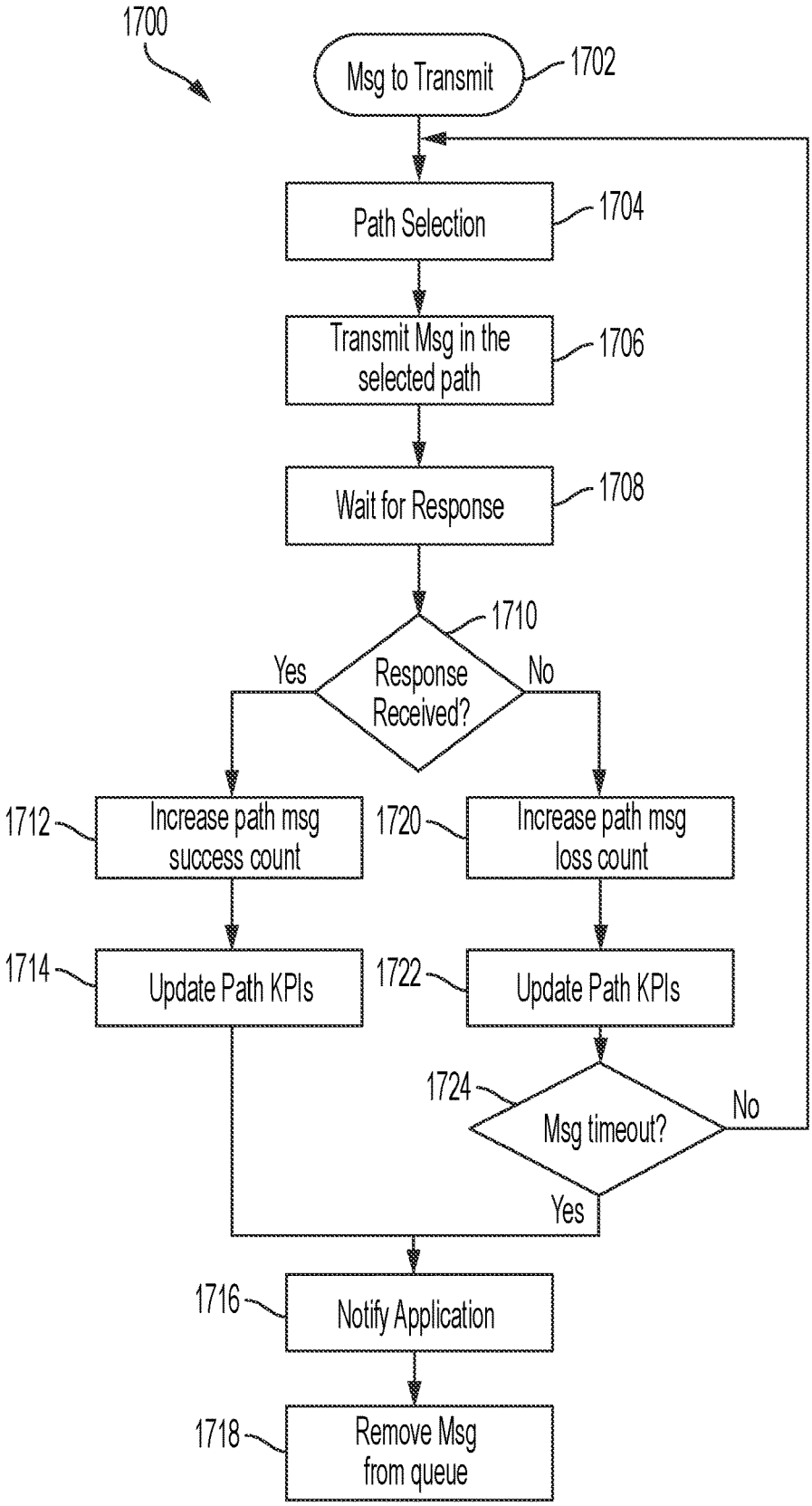
FIG. 17 is a flow chart of a process of a communications manager forwarding an EOT/HOT application message received from an EOT/HOT application to a radio for transmission by the radio.

FIG. 17 is a flow chart of a representative, non-limiting embodiment of a process performed by a communications manager when routing an EOT/HOT application message received from an EOT/HOT application to a radio with which it has at least one connection for transmission by the radio. The radio could be a 220 MHz radio, a 450 MHz radio, or a radio for another type of wireless IP network. The communication manager may be connected to one or more radios. In this example, the communications manager performs two basic processes: a process for selecting a path to route a message and a process that monitors and tracks the performance of each available communication path for the purposes of selecting a path.

The performance and monitoring process tracks one or more key performance indicators (KPI) for each available communication path. The one or more KPIs and KPI thresholds for use in selecting a path can be configured. Representative, non-limiting examples of KPIs include message count parameters for each path, as well as calculated KPIs such as message success rate (ratio of the number of successfully transmitted messages to the total number of transmitted messages). Representative examples of message count parameters that can be tracked by the communications manager include any one or more of the following: (1) the message success count, which is the number of successfully transmitted messages (response is received after the message is transmitted) for the path; (2) the message loss count, which is the number of unsuccessfully transmitted messages (no response is received after the message is transmitted) for the path; (3) the total message count for the path, which is the total number of transmitted messages including both successful and unsuccessfully transmitted messages for the path; and (4) the message retry count, which is the number of retries for messages to be transmitted for the path.

In addition to the message count parameters, link quality indicators (LQIs) may, optionally, also be used as KPIs for path selection. If the LQI information is available, the communications manager may, optionally, also update the KPIs based on the LQI information. Non-limiting, representative examples of DaIs are a received signal-to-noise ratio (SNR), a received signal-to-noise and interference (SINR), and a received signal strength indicator (RSSI). The DaIs for a given channel are determined or received by a radio to which the communication manager is connected. The radio may send any available DaIs to the communications manager. For example, in response to receiving a response to the transmitted message over an RF link, the radio may determine an LQI for the RF link and communicate it to the communications manager. When the radio receives a message over a link from another radio that carries LQI information from that radio, it may pass it to the communications manager.

Process 1700 begins by selecting at step 1702 the next EOT/HOT application message from a transmit queue. Each EOT/HOT application message received by a communication manager is placed in a transmit queue. The application message includes EOT/HOT application data and a messaging system header used for routing application messages between application messaging system endpoints in the EOT and HOT areas of the train. At step 1704, the process determines the path for forwarding or routing EOT/HOT application messages originating in the area in which the communications manager is located. The path is selected from two or more available paths for sending messages between the EOT and HOT using a path selection process such as the one disclosed below. At step 1706, the connection manager then routes the message to a radio according to the selected path. As represented by step 1708, the communication manager then waits for a preset time interval for a response indicating that the message was successfully received at the destination. If an acknowledgment message is received by the communications manager at step 1710, a message success count for the path that was used is increased at step 1712. The communication manager updates one or more KPIs for the path at step 1714, notifies the EOT/HOT application that originated the message at step 1716 and removes the message from the transmit queue at step 1718.

If a response is not received at step 1710, the communications manager increases the path message loss count at step 1720 and updates the path KPIs at step 1722. It then decides whether to transmit the application message again based on, for example, whether the application message has timed out, as represented by step 1724. If another attempt to send the application message is to be made, the communication manager repeats the process, starting with the path selection process step 1704.

Figure 18:
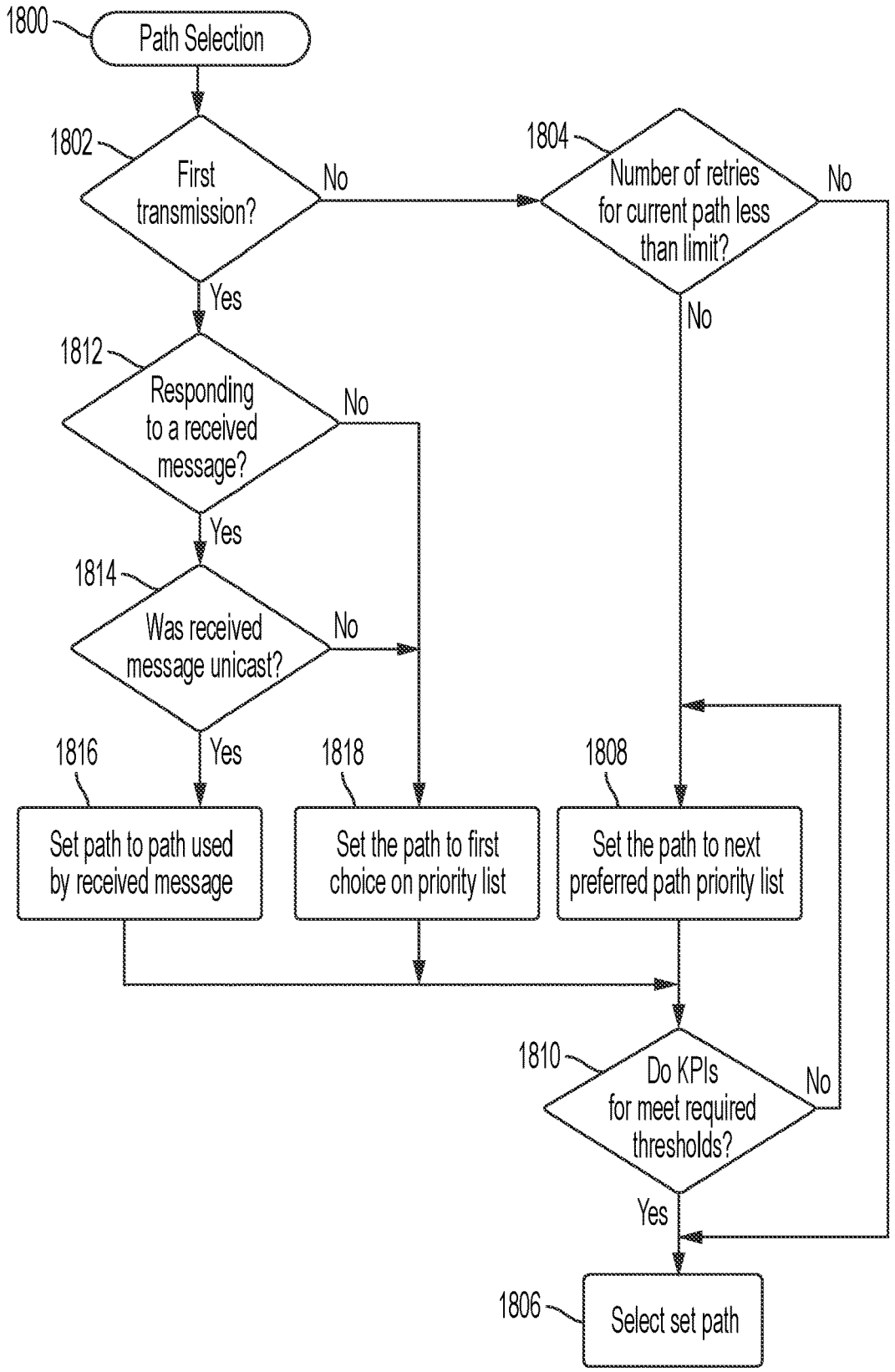
FIG. 18 is a flowchart representing a path selection process for sending an application message between EOT and HOT areas.

The flow chart of FIG. 18 represents a non-limiting, representative example of a path selection process for sending an application message between EOT and HOT areas. The process may be configured based on user-defined selection criteria, which may be updated later to further optimize the EOT/HOT communication performance. The process can be initialized using default criteria and values.

Examples of possible path selection criteria that could be used include any one or more of the following: a configured priority list in which communication paths are ordered by priority, the first available choice in the priority list being, for example, the most preferred communication path; a maximum number of transmission retries in each communication path; and any one or more or combination of path KPIs and a threshold value for each KPI.

The representative process begins at step 1800 with an application that is queued for transmission by the communication manager. The "selected path" at the beginning of the process is the previously selected path. As represented by step 1802, the process determines if the message in the queue has been transmitted before. If it has been transmitted before, the communication manager is transmitting it again (a "retry.") The process tracks and stores the number of times it has transmitted the same message and the path that was used each time. Each path has a configured limit on the number of retries that are permitted to transmit a message on the path. The limit could be zero retries or higher. If the process determines at step 1804 that the limit of retries has not been reached, the set path is not changed. The set path is thus selected to transmit the message at step 1806.

If the limit on the number of retries has been reached at step 1804, the process sets, as represented by step 1808, the path to the next preferred path in a list of paths that prioritizes the paths from most preferred to least preferred. This priority list can be configured or set based on a default priority list defined by a user at startup or initialization. It may, optionally, be updated manually or automatically based on preselected criteria.

If at step 1802, this is the first transmission of the message, the process determines at step 1812 whether the message to be transmitted is responding to a previously received message, as indicated by step 1812. If the process determines that it is a response and that the message to which it is replying was transmitted in unicast wireless packets, as indicated by step 1814, it sets the path to the path used by the received message at step 1816. If the process determines that a message queued for transmission is not a reply to a received message, or if it determines that the received message to which the message to be transmitted is responding was not sent using a unicast wireless packet, the process sets the path to the first path on the prioritized path, as indicated by step 1818.

When the process goes through a path-setting process, the process checks at step 1810 the KPIs that are being tracked for the set path. The path setting process occurs in this example except when the communications manager retries sending the message on the same path as the previous attempt. However, the process could be modified to include other exceptions that bypass the KPI check at step 1810. During the KPI check at step 1810, each KPI is checked against a threshold value. A user can manually specify and configure KPIs used for selecting a given path and the threshold values used for the KPIs. The KPIs and the threshold for each KPI need not be the same for each path. Furthermore, the KPIs and threshold values could be updated by the process in response to observed conditions. If the KPIs required to select the set path (other than for retry) for transmission are met, the set path is selected at step 1806. Otherwise, the process sets the path to the next preferred path on the priority list in step 1808, and the check of KPIs is repeated in step 1810. This loop continues until a set path meets the required threshold for the path. Although not indicated in the figure, if the end of the priority list is reached, the process may cycle back to the top of the list and repeat. Although not indicated in the drawing, if none of the available paths have KPIs that meet the necessary thresholds, other criteria could be employed, such as selecting the path with the best KPIs.

Once the path is selected at step 1806, the communication manager forwards the message to a radio using a route corresponding to the selected path. As previously described, it then waits for a predetermined period to receive a response to the message. If the response to the transmitted message is received within the wait period, the communication manager process will increase the message success count, update the KPIs of the selected path, notify the application that the message is successfully transmitted, and remove the message from its transmit queue. Otherwise, it will increase the message loss count and update the KPIs of the selected path. If LQI information for the selected path is received, it will update the KPIs for the path based on the LQI information.

If the transmission of the message is not successful because a response to the transmitted message has not been received and the message has timed out, the communications manager notifies the application that the message is lost and removes the message from transmit queue. Each application message preferably has a time-to-live that is part of the messaging system header and will time out when the time-to-live period expires. If the message has not timed out, the communication manager will continue to try to send the message using the same path, or if the number of retries for the path has reached a limit, go through a path selection process as described above.

The processes of the communication manager and all other processes described herein, including those illustrated by the figures can be, for example, implemented as instructions that are stored as software or firmware in memory and can be executed by one or more processors to carry out the processes, instructions for programming one or more programmable logic circuits, applications-specific circuits, or combinations of them. Representative examples of processors include microprocessors, specialized microprocessors such as digital signal processors, and microcontrollers. Representative, nonlimiting examples of user-programmable circuits include programmable logic devices, field programmable gate arrays (FPGA), and types of user-programmable circuits. The term "machine-readable storage medium" or "computer-readable medium" as used herein refers to any medium or media that stores instructions that, for example, are: directly or indirectly (such as after compilation, interpretation, or transfer to storage memory or working memory) executed by a processor to perform process; and, in the case of a user programmable circuit, such as FPGA, instructions for programming the circuit and the storage of instructions by the programmable circuit to perform a process. Such process will be referred to as a "computer implemented process." Such a storage medium may take many forms. Non-limiting, representative examples include non-volatile media, volatile media, and transmission media. Volatile media include, for example, random access memory (RAM). Non-volatile media include, for example, optical or magnetic disks, any type of nonvolatile RAM, any type of read only memory (ROM), any type of electrically erasable programmable read-only memory (EEPROM), and logic that has been programmed. Transmission media include coaxial cables, copper wire, and fiber optics. A program or "computer program" is a set of instructions for performing a process, part of a process, or a function. It does not necessarily correspond to a file of a file system. A program can comprise multiple files or be stored in a portion of a file that holds other programs or data. A program or portions of it can be stored or executed on one device or multiple devices at one site or multiple interconnected by a communication network.

The preceding description is of non-limiting, representative examples of various apparatus and methods embodying different aspects of the disclosure. Alterations and modifications to the disclosed examples and the embodiments may be made without departing from an aspect being explained, described, or claimed. Furthermore, unless expressly defined otherwise, the meaning of a term used in this specification that is not explicitly defined is intended to have its ordinary and customary meaning to someone in the art and is not intended to be limited by the example being described or to the embodiment.

What is claimed is:

1. In a train having at least one railroad application in an end of train (EOT) area and at least one railroad application in a head of train (HOT) area, each path having at least one RF segment, a computer implemented method of routing application messages between the EOT area and the HOT area comprising:

receiving from a source railroad application in an originating area of a train an application message to be transported to a railroad application in a destination area of the train, the originating area being either the EOT area or a HOT area and the destination area being the other of the EOT and HOT areas and the message including one or more headers of an application-level messaging protocol;

selecting a path from two or more paths with which the origination area has been configured to send application messages to the destination area, each of the two or more paths having at least one segment that comprises an RF transport; and routing according to the selected path the message to a radio within the originating area for wireless transmission;

wherein at least one of the two or more available paths comprises a path from a group of paths consisting of: one or more direct wireless paths between the EOT area and the HOT area; one or more indirect paths through a wireless train control network; one or more indirect paths through one or more intermediate, remote radios; and one or more indirect paths through one or more mobile cellular radio, satellite communication, or Wi-Fi networks; and wherein at least one of the two or more paths includes a direct wireless path comprising an RF transport radio link between a radio in the EOT area and a radio in the HOT area.

2. The method of claim 1, wherein the at least one RF transport comprises one or more RF transports from the following group: a wireless train control network RF transport; an RF transport comprising an AAR-specified RF transport for communication between an EOT and HOT; RF transport of a mobile cellular radio network; an RF transport of a satellite radio network; and RF for a Wi-Fi network.

3. The method of claim 2 wherein the two or more paths include a direct path between the EOT and the HOT area, wherein the RF transport comprises the AAR-specified RF transport for communication between an EOT and HOT transport.

4. The method of claim 3, wherein the AAR-specified RF transport is AAR S-9152.

5. The method of claim 3, wherein the two or more paths further include another direct path between the EOT and HOT with an AAR-specified RF transport for communication between an EOT and HOT at a data rate higher than a data rate specified by the AAR-specified RF transport.

6. The method of claim 2 wherein, the wireless train control network RF transport comprises an Interoperable Train Control Radio (ITCR) RF transport; and at least one of the two or more possible paths comprises a direct wireless path between the EOT area and the HOT area comprising the ITCR RF transport.

7. The method of claim 6 wherein the application message is wirelessly transmitted over the ITCR RF transport in a common channel.

8. The method of claim 1 wherein the two or more available paths include an indirect path through one or more intermediate radios that repeat wireless packets received from the originating area over one or more RF transports.

9. The method of claim 8, wherein at least one of the one or more RF transports is a wireless train control network RF transport.

10. The method of claim 8, wherein at least one of the one or more RF transport is an RF transport comprising an AAR-specified RF transport for communication between an EOT and HOT.

11. The method of claim 1, wherein at least one of the two or more available paths comprises an indirect path through a wireless train control network, the indirect path comprising a wireless train control network RF transport link with a first base station over a local channel, the wireless train control network transporting the application message to a second base station for transmission to the destination area.

12. The method of claim 1, wherein the one or more headers of an application-level messaging protocol comprise a header formatted according to the Edge Messaging Protocol (EMP) standard.

13. The method of claim 12 further comprising tracking performance of at least one of the two or more available paths using one or more predetermined key performance indicators (KPIs) for at least one of the two or more available paths; wherein selecting a path from the two or more paths is based on one or more of the predetermined KPIs, the one or more predetermined KPIs comprising at least a message count parameter, a calculated KPI, or a link quality indicator.

14. The method of claim 13, wherein the one or more predetermined KPIs comprise one or more of a message count parameter, a calculated KPI, or a link quality indicator of at least one RF transport link.

15. The method of claim 14, wherein the message count parameter is selected from a group of parameters consisting of: a number of successfully transmitted application messages based on responses to the application message after the message is transmitted; a number of unsuccessfully transmitted messages based on no response being received after the message is transmitted; a total message count for the path; and count of the number of retries for an application message to be transmitted for the path.

16. The method of claim 14, wherein the one or more predetermined KPIs includes a message success rate.

17. The method of claim 1, wherein:

the two or more available paths comprise at least a first path and a second path and the selecting a path from two or more paths with which the origination area has been configured to send application messages to the destination area application comprises selecting the first path;

in response to determining that the application message was not received at the destination area, retrying at least once routing the application message on the first path and, in response to determining that the application message was not received after the at least one retry selecting the second path and routing the application message according to a second path.

18. The method of claim 1, wherein selecting a path from the two or more paths for transporting the application message between the origination area and the destination area comprises selecting the path last used for successful transmission of an application message.

19. A computer implemented method of routing application messages between railroad applications in an end of train (EOT) area and a head of train (HOT) area of a train, the method comprising:

in response to receiving an application message from a railroad application in an originating area of a train that is to be sent to a destination area, the originating area being one of the EOT or HOT areas of the train and the destination area being the other of the EOT and HOT areas of the train, selecting a path from two or more paths with which the origination area has been configured to send application messages to the destination area, each of the two or more paths having at least one segment that comprises an RF transport; and routing the message to a radio within the origination area for wireless transmission based on the selected path; and tracking performance of at least one of the two or more possible paths using one or more predetermined key performance indicators (KPIs);

wherein, at least one of the two or more available paths comprises a path in a group of paths consisting of one or more direct wireless paths between the EOT area and the HOT area, one or more indirect paths through a wireless train control network, one or more indirect paths through one or more intermediate remote radios, and one or more indirect paths through one or more mobile cellular radio, satellite communication, or Wi-Fi networks;

wherein, at least one of the two or more paths includes a direct wireless path comprising an RF transport radio link between a radio in the EOT area and a radio in the HOT area; and wherein, selecting a path from the two or more paths is based at least in part on one or more of the predetermined KPIs.

20. The method of claim 19, further comprising, in response to determining that transmission of an application message on the first path is not successful, selecting another of the two or more available paths as a new path and routing the application message for retransmission according to the new path.

21. The method of claim 20 further comprises retrying transmission of the message on the first path at least once if transmission of the application message is not successful and, if the retrying on the first path at least once is not successful, selecting the new path.

22. The method of claim 20 wherein selecting another of the two or more available paths as the new path if transmission of an application message on the first path is not successful is based at least in part on the one or more predetermined KPIs.

23. The method of claim 22, wherein the one or more predetermined KPIs comprise one or more of a message count parameter, a calculated KPI, or a link quality indicator of at least one RF transport link.

* * * * *